US005793399A

United States Patent [19]

Kawakami et al.

[11] Patent Number: 5,793,399

[45] Date of Patent: Aug. 11, 1998

[54] SHEET SUPPLYING APPARATUS

[75] Inventors: Hideaki Kawakami; Akira Miyakawa; Katsuyuki Yokoi, all of Yokohama; Soichi Hiramatsu, Hachioji; Hideki Yamaguchi, Yokohama; Hiroyuki Inoue, Yokohama; Takashi Nojima, Tokyo; Hitoshi Nakamura, Kawasaki; Akira Kida, Yokohama; Takeshi Iwasaki, Yokohama, all of Japan

[73] Assignee: Canon Kabushiki Kaisha, Tokyo, Japan

[21] Appl. No.: 361,047

[22] Filed: Dec. 21, 1994

[30] Foreign Application Priority Data

Dec. 27, 1993 [JP] Japan ..... 5-332689
Jan. 24, 1994 [JP] Japan ..... 6-005581

[51] Int. Cl.[6] ..... B41J 2/01

[52] U.S. Cl. ..... 347/104; 347/30; 271/10.09; 271/10.11; 271/114; 475/174

[58] Field of Search ..... 347/104, 30; 346/134; 271/121, 124, 125, 114, 10.09, 10.11; 475/903, 190, 191, 174

[56] References Cited

U.S. PATENT DOCUMENTS

| | | | |
|---|---|---|---|
| 3,966,198 | 6/1976 | Komada et al. . | |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,529,188 | 7/1985 | Sturnick . | |
| 4,544,294 | 10/1985 | Runzi . | |
| 4,558,333 | 12/1985 | Sugitani et al. | 347/65 |
| 4,581,618 | 4/1986 | Watanabe et al. . | |
| 4,608,577 | 8/1986 | Hori | 347/66 |
| 4,638,987 | 1/1987 | Sakurai . | |
| 4,691,911 | 9/1987 | Nakagawa et al. . | |
| 4,721,297 | 1/1988 | Katayama . | |
| 4,723,129 | 2/1988 | Endo et al. | 347/56 |
| 4,740,796 | 4/1988 | Endo et al. | 347/56 |
| 4,798,374 | 1/1989 | Ito . | |
| 4,866,531 | 9/1989 | Watanabe et al. . | |
| 4,884,909 | 12/1989 | Koburi et al. . | |
| 4,953,037 | 8/1990 | Ito et al. . | |
| 5,118,090 | 6/1992 | Sonoda et al. | 271/10.11 |
| 5,138,343 | 8/1992 | Aichi et al. | 347/30 |
| 5,141,346 | 8/1992 | Nakagawa | 271/114 |
| 5,184,902 | 2/1993 | Harada et al. . | |
| 5,211,690 | 5/1993 | Mizoguchi et al. . | |
| 5,226,639 | 7/1993 | Kida et al. | 271/264 |
| 5,370,380 | 12/1994 | Suzuki et al. . | |
| 5,523,858 | 6/1996 | Yanada et al. | 271/9.01 |

FOREIGN PATENT DOCUMENTS

| | | |
|---|---|---|
| 0 069 384 | 1/1993 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |

OTHER PUBLICATIONS

Patent Abstracts of Japan, vol. 4, No. 187 (M-048), 23 Dec. 1980, & JP-A-55-132 258 (Canon), 14 Oct. 1980.

*Primary Examiner*—John E. Barlow, Jr.
*Attorney, Agent, or Firm*—Fitpatrick, Cella, Harper & Scinto

[57] ABSTRACT

The present invention provides a recording apparatus comprising a supply means for supplying a sheet in a predetermined direction, a convey means for conveying the sheet supplied by the supply means in a predetermined direction, a recording means for recording an image on the sheet conveyed by the convey means, in response to image information, a reversible drive means for driving the supply means and the convey means, and a drive transmitting means for transmitting a driving force from the drive means to the supply means or the convey means, and wherein the drive transmitting means comprises a plurality of planetary gears as means for rotating the supply means only in a sheet supplying direction regardless of a rotational direction of the convey means, and the planetary gears are revolved around gears having different speed reduction ratios from the drive means as sun gears, respectively. The present invention also provides a sheet supplying apparatus and a drive transmitting mechanism used with such a recording apparatus.

29 Claims, 20 Drawing Sheets

SHEET SUPPLYING APPARATUS

BACKGROUND OF THE INVENTION

1. Field of the Invention

The present invention relates to a sheet conveying apparatus used with a recording apparatus such as a printer, a copying machine, a facsimile and the like, and more particularly relates to a sheet conveying apparatus wherein a driving force from a drive means is switched between a sheet supply means and a convey means.

The present invention further relates to a drive transmitting mechanism used with a recording apparatus (printer) or an image forming apparatus such as a copying machine, a facsimile and the like, for example, acting as an information outputting apparatus of a computer, and more particularly relates to a driving force transmitting mechanism for effecting drive transmission by a planetary gear.

2. Related Background Art

In the past, recording apparatuses used with a printer, a copying machine, a facsimile and the like or recording apparatuses used as an output equipment for a composite system or a work station including a computer or a word processor are designed so that an image (including a character, a symbol or the like) is recorded on a recording material such as a paper sheet or a thin plastic film (for example, an OHP sheet). These recording apparatuses can be grouped into ink jet recording type, wire dot recording type, heat-sensitive recording type, heat-transfer recording type, laser beam recording type and the like in accordance with the kinds of recording means to be used.

Among the above-mentioned recording apparatuses, in a recording apparatus of serial type in which main scan is effected along a direction perpendicular to a conveying direction of the recording material (sub-scan direction), after the recording material is set on a predetermined recording position, the image (including character, symbol or the like) is recorded on the recording material. After one-line recording is finished, the recording material is conveyed by a predetermined amount (sub-scan) and then a next one-line recording is effected (main scan). By repeating these operations, the images are recorded on the recording material within a desired recording range. On the other hand, in a recording apparatus of line type in which the recording is effected only by using the sub-scan (i.e., by conveying the recording material only in the conveying direction), after the recording material is set on a predetermined recording position, the recording for one-line is effected in bloc and then the recording material is conveyed by a predetermined amount (pitch convey). By repeating these operations, the images are recorded on the recording material within a desired recording range.

Among them, a recording apparatus of ink jet type (referred to as "ink jet recording apparatus" hereinafter) is designed so as to record an image by discharging ink from a recording means (recording head) toward a recording material and has advantages that the recording means can easily be made compact, that highly accurate fine image can be recorded at a high speed, that the image can be recorded on a plain paper sheet without any special treatment, that the running cost is cheap, that noise can be reduced because of non-impact recording and that a color image can easily be recorded by utilizing a plurality of different color inks.

Particularly, in an ink jet recording means (recording head) for discharging ink by utilizing thermal energy, high density liquid passage arrangement (arrangement of discharge openings with high density) can easily be achieved by forming electrothermal converters deposited on a substrate, electroles, liquid passage walls and a top plate by means of semi-conductor process such as etching, depositing, spattering or the like, thereby making the recording means more compact. By making use of the advantages of IC techniques and micro-working techniques, an elongated recording means and/or a two-dimensional recording means can easily be obtained, and the recording means can easily be mounted in a full-multi fashion and with high density.

In the ink jet recording apparatuses, since the recording head has generally fine discharge openings arranged side by side, if bubble or dust is entered into the discharge opening or if viscosity of ink is increased by vaporization of ink solvent to make the ink discharge or recording impossible, a discharge recovery treatment for removing the discharge preventing factors is effected to refresh the ink.

In general, in the recording apparatuses of serial type, a stepping motor is often used as a carriage drive motor for shifting the recording head in the main scan direction. Further, a stepping motor is often used as a drive motor for shifting the recording material in a direction perpendicular to a carriage shifting direction. Furthermore, in order to reduce the number of motors (drive sources) to save the cost and the available space, the respective motor has been used for driving a plurality of elements.

In the ink jet recording apparatuses, it has been proposed that an operation for conveying the recording material and the recording head recovery operation are performed by a single drive source. Now, an example of a conventional ink jet recording apparatus will be explained with reference to FIGS. 25 and 26.

In FIG. 25, a motor (drive source) 251 serves to perform the recording material conveying operation and the recording head recovery operation. A drive gear 252 for transmitting a driving force to an ASF (automatic sheet feeder) has two different diameter portions. The drive gear 252 is meshed with a sun gear 253*a*. The sun gear 253*a* and a sun gear 253*b* are secured to a rotary shaft 258. Arms 255*a*, 255*b* are attached to the rotary shaft 258 via springs for applying friction and planetary gears 254*a*, 254*b* are held on the arms 255*a*, 255*b*, respectively. After the arms 255*a*, 255*b* are assembled, the sun gears 253*a*, 253*b* are secured to the rotary shaft 258 by pins and the like so that the sun gears can be rotated together with the rotary shaft. Idler gears 256*a*, 256*b* are secured to a common shaft and serve to change a rotational direction, so that, when the arm 255*a* is rotated in a predetermined direction, the planetary gear 254*a* is engaged by the idler gear 256*a*. Further, the idler gear 256*b* is meshed with a driving force transmitting gear 257 mounted on an end of a shaft of a sheet supply rotary member 259 (FIG. 26). When the arm 255*b* is rotated in a predetermined direction, the planetary gear 254*b* is engaged by the driving force transmitting gear 257. As a result, the sheet supply rotary member 259 is rotated in a given direction regardless of a rotational direction of the motor 251.

In FIG. 26, a convey gear 261 is press-fitted on an end of a shaft of a convey roller 260 for conveying a recording material. A pinch roller 263 is urged against the convey roller 260 by a biasing spring 262. A driving force of the motor 251 is transmitted to the convey gear 261 via a driving force transmitting gear 264 so that the convey roller 260 cooperates with the pinch roller 263 to convey the recording material onto a platen 265.

Next, explaining a driving force transmitting operation with reference to FIGS. 25 and 26, when the motor 251 is rotated in a direction shown by the arrow b in FIG. 25 (reverse rotation of the convey roller 260), the sun gear 253*a* is rotated in the direction b through the ASF drive gear 252. In this case, after the arm 255*a* is rotated in the direction b from a contact position between stoppers 255*c*, 255*d* through a predetermined non-transmitting angle, the planetary gear 254*a* is engaged by the idler gear 256*a*. The driving force transmitting gear 257 is rotated in the direction a via the idler gear 256*b*, thereby rotating the sheet supply rotary member 259 in the same direction to separate an uppermost recording material from the other recording materials, and the separated recording material is sent between the pair of convey rollers 260, 263 (convey roller and pinch roller). In this case, since the convey roller 260 is rotated in the reverse direction, the recording material conveyed by the sheet supply rotary member 259 is alinged with a nip between the pair of convey rollers 260, 263. Further, since the recovery operation for the recording head is effected by utilizing reverse rotation of the motor 251, it is necessary to prevent the driving force from being transmitted to the sheet supply rotary member while the motor 251 is being rotated. Accordingly, the above-mentioned predetermined non-transmitting angle must be set to be greater than an amount of the reverse rotation of the motor 251 for effecting the recovery operation.

Further, when the motor 251 is rotated in a direction shown by the arrow f (normal rotation of the convey roller 260), the sun gear 253*b* is also rotated in the direction f to rotate the arm 255*b* in the same direction from the contact position between stoppers 255*e*, 255*f*, thereby engaging the planetary gear 254*b* by the driving force transmitting gear 257. Since the convey roller 260 is rotated in the normal direction, the recording material abutted against the nip between the pair of convey rollers 260, 263 is positioned at a predetermined recording position on the platen 265 where the recording material is opposed to the recording head. In this case, since a thick recording material such as an envelope, a post card or the like itself cannot be smoothly entered into the nip between the pair of convey rollers 260, 263, it is necessary to push the thick recording material into the nip. Since the driving force transmitting gear 257 is rotated in a direction shown by the arrow a by the driving force from the planetary gear 254*b*, the sheet supply rotary member 259 is also rotated.

Further, in general, in order to revolve a planetary gear in response to rotation of a sun gear, a friction force must be applied to a side surface of the planetary gear. FIG. 27 shows an example of a conventional mechanism for applying a friction force to a planetary gear. In FIG. 27, a sun gear 266 is meshed with a planetary gear 267 so that the planetary gear is revolved around the sun gear. The sun gear 266 and the planetary gear 267 are supported by an arm 268, and the planetary gear 267 is biased by a coil spring 269 to be urged against the arm 268. Incidentally, the reference numeral 270 denotes a bush nut for securing the coil spring 269 to the arm 268.

The sun gear 266 and the arm 268 are mounted on a common shaft (not shown), and a driving force transmitted to the sun gear 266 from a drive source (not shown) is transmitted to a gear and the like (not shown) via the planetary gear 267. Since the planetary gear 267 is urged against the arm 268 by the coil spring 269, friction is generated between the planetary gear and the arm to resist against the rotation of the planetary gear 267, with the result that the planetary gear 267 is surely be revolved around the sun gear 266.

In a driving force transmitting mechanism using the above-mentioned planetary gear, a notched gear is often used as a control means for controlling a rotational angle of a gear by which the planetary gear is engaged. An example of such a mechanism is shown in FIG. 28. In FIG. 28, a planetary gear 272 is meshed with a sun gear 271 so that the planetary gear 272 can be revolved around the sun gear 271. A pickup gear 273 having a notched portion (non-toothed portion) at its periphery is meshed with the planetary gear 272. The sun gear 271 is rotated in a direction shown by the arrow by a driving force from a drive source (not shown). As a result, the planetary gear 272 is revolved around the sun gear 271 in a direction shown by the arrow until it is engaged by the pick-up gear 273. When the planetary gear 272 is engaged by the pick-up gear 273, the latter is rotated in a direction shown by the arrow until the notched portion is opposed to the planetary gear. In this point, the pick-up gear is stopped.

However, as for the above-mentioned conventional techniques, in the arrangement regarding the sun gear and the planetary gear as shown in FIGS. 25 and 26, since the speed of the planetary gear 254*b* is greatly decreased until the planetary gear 254*b* reaches a position where it is rotated in the normal direction, there is a time difference between a time when the pair of convey rollers 260, 263 are started to rotate after the rotational direction of the motor 251 is changed from the reverse rotation to the normal direction and a time when the sheet supply rotary member 259 is started to rotate, with the result that, particularly regarding the thick recording material such as the envelope, post card or the like which is required to be pushed into the nip between the pair of convey rollers 260, 263, the heading amount of the recording material is changed in dependence upon the difference in the penetrated amount of the recording material into the nip when the recording material is abutted against the nip.

Further, in order to hasten the timing of the engagement of the planetary gear 254*b* to be rotated in the normal direction, it is necessary to set a position of the sun gear (around which the planetary gear 254*b* is revolved) in the proximity of the motor 251 having the small speed reduction rate. However, since the reverse rotation of the motor 251 is utilized for effecting the recovery operation for the recording head, if the position of the sun gear (around which the planetary gear 254*a* is revolved in the reverse rotation) is set in the proximity of the motor 251 having the small speed reduction rate, the revolution angle of the planetary gear must be increased in order not to transmit the driving force to the sheet supply rotary member 259 during the recovery operation. To the contrary, in order to decrease the revolution angle of the planetary gear 254*a* to be rotated in the reverse rotation, the sun gear (around which the planetary gear 254*a* is revolved) is set in a position remote from the motor 251 having the small speed reduction rate.

Further, in the friction applying mechanism as shown in FIG. 27, the number of parts is increased and an axial thickness of the planetary gear is also increased, thereby making the mechanism bulky.

Furthermore, in the rotation angle control means as shown in FIG. 28, when the planetary gear 272 is encountered with the notched portion of the pick-up gear 273, if the pick-up gear 273 is subjected to any load, the pick-up gear 273 will not be completely rotated, with the result that an end tooth of the notched portion of the pick-up gear 273 is struck against the tooth of the planetary gear 272, thereby generating the noise.

Conventionally, in the recording apparatuses, there has been used a mechanism wherein a recording material is picked up from a recording material containing means such as a cassette by means of a sheet supply roller to convey the recording material to a convey roller, and a driving force switching technique utilizing a planetary gear has been used in a driving force transmitting mechanism. Now, such a driving force transmitting mechanism will be explained with reference to FIGS. 29 to 31. Incidentally, in FIGS. 29 to 31, a direction shown by the solid line arrow (clockwise direction) is referred to as "forward (normal) direction" and a direction shown by the broken line arrow (anti-clockwise direction) is referred to as "reverse direction".

In FIG. 29, a motor gear 352 is attached to a drive shaft of a drive motor 351. An idler gear 353 has a large diameter gear portion meshed with the motor gear 352, and a small diameter gear portion. A first roller gear 354 secured to a first convey roller shaft 355 of a first convey roller (not shown) is meshed with a small diameter portion of the idler gear 353. Accordingly, a driving force of the drive motor 351 is transmitted to the first roller gear 354 via the idler gear 353, thereby rotating the first convey roller.

Further, in FIGS. 30 and 31, a second roller gear 356 is attached to the first convey roller shaft 355 of the first convey roller (not shown). A planetary gear 357 is meshed with the second roller gear 356 so that it can be revolved around the second roller gear 356 acting as a sun gear. A lever 358 is rotatably mounted on the first convey roller shaft 355. The planetary gear 357 is held at one end of the lever 358. A lever holding member 359 serves to control rotation and stoppage of the lever 358 and is shifted by an electromagentic solenoid and the like (not shown).

A second convey roller gear 360 is secured to a second convey roller shaft 361 of a second convey roller (not shown). An idler gear 362 is meshed with a sheet supply roller gear 364 secured to a sheet supply roller shaft 363 of a sheet supply roller (not shown). The planetary gear 357 is revolved around the second roller gear 356 in response to normal rotation or reverse rotation of the second roller gear 356 so that the planetary gear is engaged by the second convey roller gear 360 or the idler gear 362.

As shown in FIG. 30, while the lever 358 is being held by the lever holding member 359, the planetary gear 357 is engaged by the second convey roller gear 360 regardless of the normal and reverse rotations of the second roller gear 256 (and the first roller gear 354), thereby transmitting a driving force of the first convey roller (not shown) to the second convey roller (not shown).

On the other hand, as shown in FIG. 31, in a condition that the lever 358 is released from the lever holding member 359, when the second roller gear 356 (and the first roller gear 354) is rotated in the normal direction, the planetary gear 357 is engaged by the second convey roller gear 260, thereby transmitting the driving force of the first convey roller (not shown) to the second convey roller (not shown). Further, when the second roller gear 256 is rotated in the reverse direction (anti-clockwise direction), the planetary gear 357 is engaged by the idler gear 362, thereby transmitting the driving force of the first convey roller (not shown) to the sheet supply roller (not shown).

However, in the above-mentioned conventional technique, since the planetary gear 357 is mounted on the lever 358 and the lever holding member 359 controls the lever 358, when the lever 358 is held by the lever holding member 359, a position of the planetary gear 357 is varied with the manufacturing accuracy of the lever 358, lever holding member 359 and the like. Consequently, the planetary gear 357 is strongly urged against the second convey roller gear 360 to worsen the durability of the gears, or great play is generated between the planetary gear 357 and the second convey roller gear 360, thereby causing a risk that, when the second convey roller gear 360 is rotated in the reverse direction, the planetary gear 357 is shifted toward the sheet supply roller gear 364 to skip the tooth of the second convey roller gear 360. If the skipping of the tooth is generated, a back feed amount of the recording material will be unstable (i.e., not constant), thereby worsening the image quality.

SUMMARY OF THE INVENTION

A first object of the present invention is to provide a recording apparatus which can eliminate the above-mentioned conventional drawbacks and can reduce a time difference between the initiation of an operation of a convey means and the initiation of an operation of a sheet supply means when a rotational direction of a drive means is changed from a reverse direction to a normal direction, thereby stabilizing the heading of a recording material.

A second object of the present invention is to provide a recording apparatus which can reduce a revolution angle of a planetary gear which is operated in a reverse direction, in order not to transmit a driving force of a drive means to a sheet supply means when the drive means is rotated in a reverse direction.

A third object of the present invention is to provide a recording apparatus in which a friction force can positively be applied to a planetary gear for rotation with saving a space.

A fourth object of the present invention is to provide a recording apparatus which can prevent noise from generating at a notched portion of a notched gear in a drive transmitting mechanism using the notched gear for rotation control.

To achieve the above objects, according to the present invention, there is provided a recording apparatus comprising a sheet supply means for supplying a sheet in a predetermined direction, a convey means for conveying the sheet supplied by the sheet supply means in a predetermined direction, a recording means for recording an image on the sheet conveyed by the convey means, in response to image information, a reversible drive means for driving the sheet supply means and the convey means, and a drive transmitting means for transmitting a driving force of the drive means to the sheet supply means or the convey means, and wherein the drive transmitting means has a plurality of planetary gears acting as a means for rotating the sheet supply means only in a sheet supplying direction regardless of a rotational direction of the convey means, and the planetary gears are revolved around respective gears (acting as sun gears) having different speed reduction ratios from the drive means.

With this arrangement, since the planetary gear to be revolved when the drive means is rotated in the reverse direction is revolved at a position remote from the drive means (great speed reduction position) and the planetary gear to be revolved when the drive means is rotated in the normal direction is revolved at a position near the drive means (small speed reduction position), as soon as the rotational direction of the drive means is changed from the reverse direction to the normal direction, the driving force can be transmitted to the sheet supply means. Further, it is possible to reduce a revolution angle of the planetary gear for preventing transmission of the driving force to the sheet supply means during an recovery operation for the recording means when the convey means is rotated in the reverse direction.

Further, when a tension force is applied to the planetary gear by utilizing elasticity of a resin member (mounted in coaxial with the sun gear) for holding the planetary gear, the number of parts can be decreased, thereby saving a space and making the apparatus compact.

In addition, when the planetary gear is rotated from an engagement position where the planetary gear is engaged by a notched gear to a non-toothed position where the planetary gear is not engaged by the notched gear, since the planetary gear is not struck against an end tooth of the notch, noise due to the impact between the teeth can be prevented.

The other object of the present invention is to provide a recording apparatus which can eliminate the above-mentioned conventional drawbacks and which has a drive transmitting means capable of transmitting a driving force stably, thereby maintaining good image quality and improving reliability.

To achieve this object, according to the present invention, there is provided a recording apparatus comprising a drive shaft having a gear for transmitting a driving force, a plurality of driven shafts to which the driving force is selectively transmitted in accordance with a normal rotation or a reverse rotation of the drive shaft, a planetary gear which can be engaged by the gear of the drive shaft to transmit the driving force to any one of the driven shafts, a rotatable member freely rotated on the drive shaft and adapted to hold the planetary gear, a rotatable member holding member for holding the rotatable member at a predetermined position, and a biasing means for biasing the rotatable member toward a rotational direction of the drive shaft, and wherein the rotatable member comprises a first rotary member rotatable in coaxial with the drive shaft and adapted to hold the planetary gear, and a second rotary member rotatable in coaxial with the drive shaft and adapted to be engaged by the rotatable member holding member, and further wherein, when the second rotary member is held by the rotatable member holding member, the planetary gear is engaged by a gear on any one of the driven shafts with a predetermined biasing force.

With this arrangement, when the drive shaft is rotated in a predetermined direction, the rotatable member holding the planetary gear is rotated to be engaged by the gear on any one of the driven shafts. And, when the second rotary member is held by the rotatable member holding member at the predetermined position, the planetary gear is engaged by the gear on any one of the driven shafts with the predetermined biasing force regardless of the rotational direction of the drive shaft.

DETAILED DESCRIPTION OF THE PREFERRED EMBODIMENTS

Figure 1:
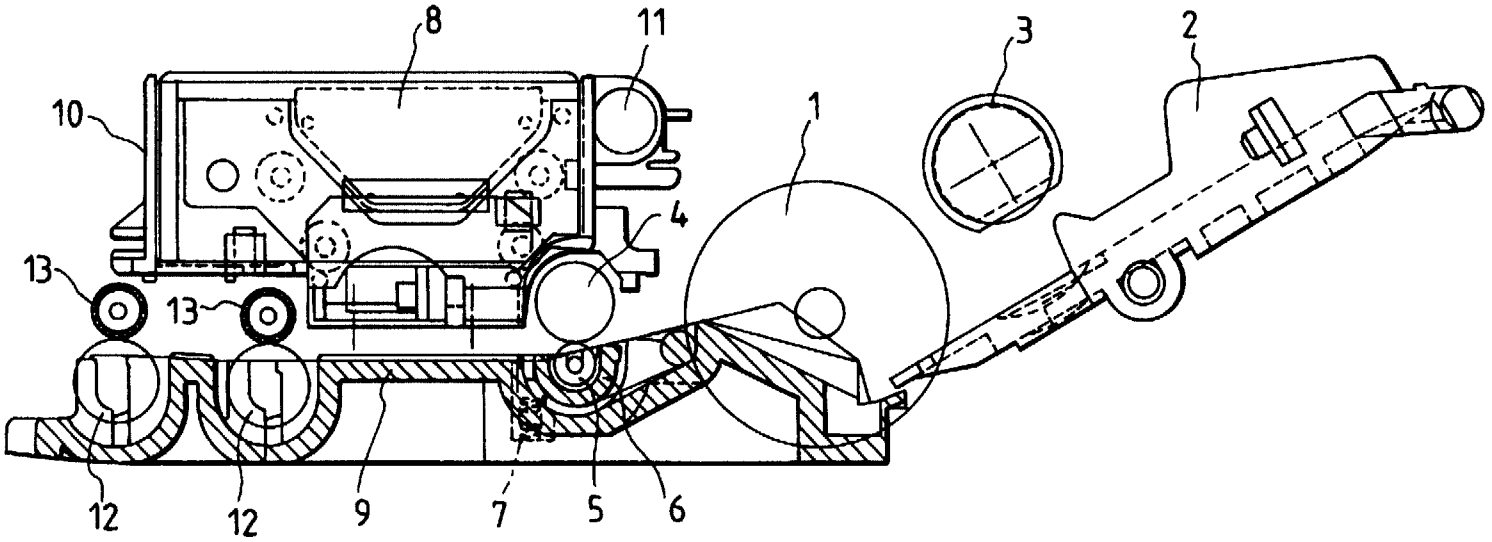
FIG. 1 is a sectional view of an ink jet recording apparatus according to a first embodiment of the present invention.
Figure 2:
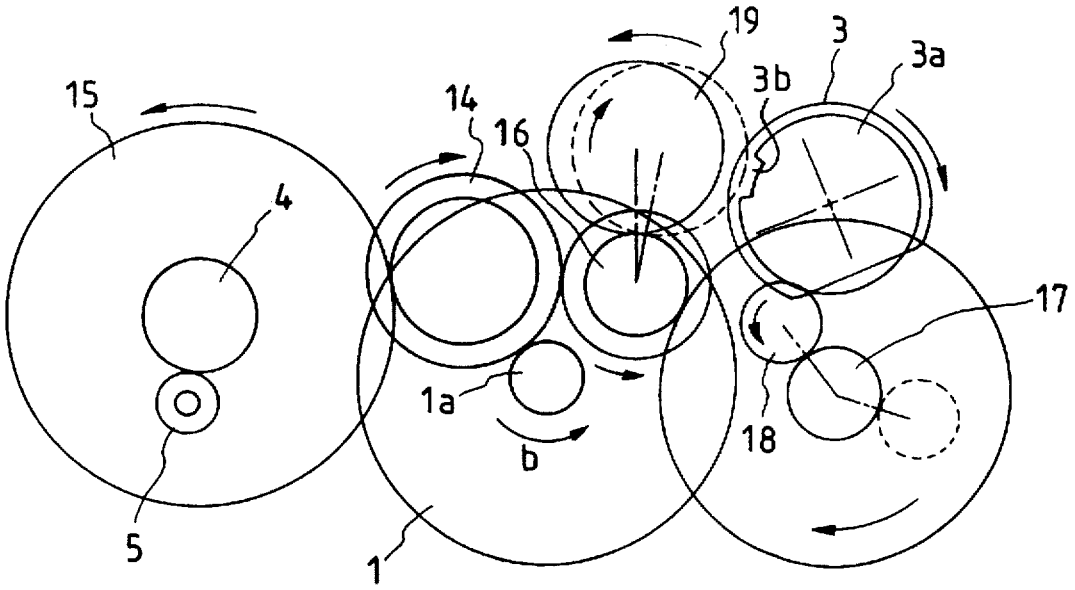
FIGS. 2 and 3 are views for explaining a driving force transmitting mechanism.
Figure 3:
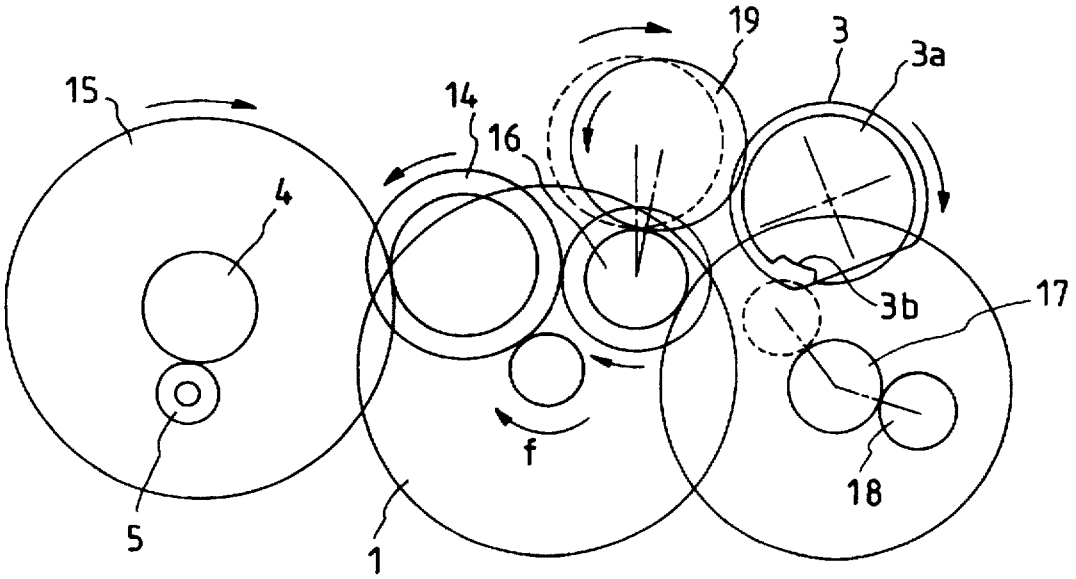
Figure 4:
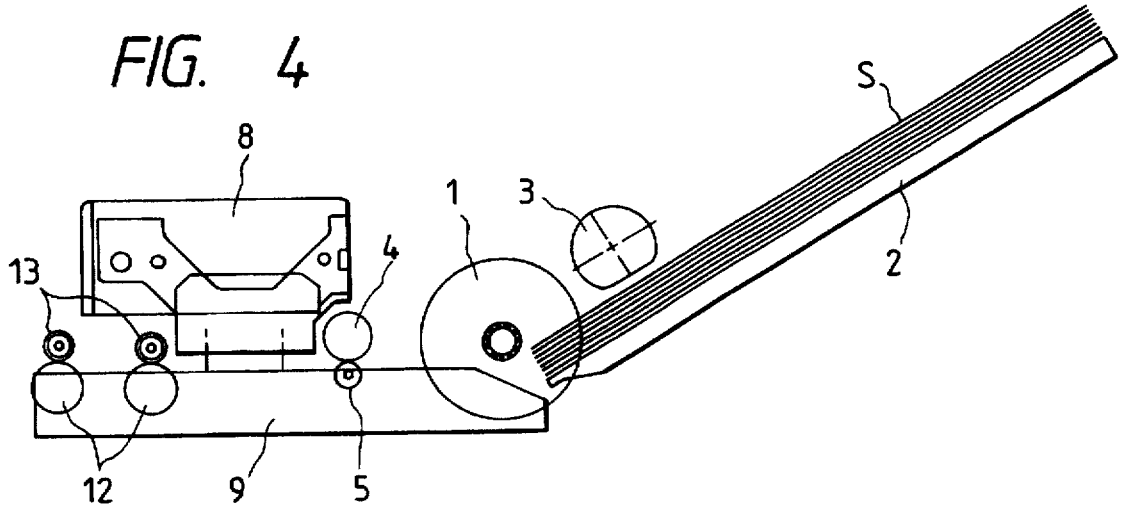
FIGS. 4 to 6 are views for explaining a recording operation.
Figure 5:
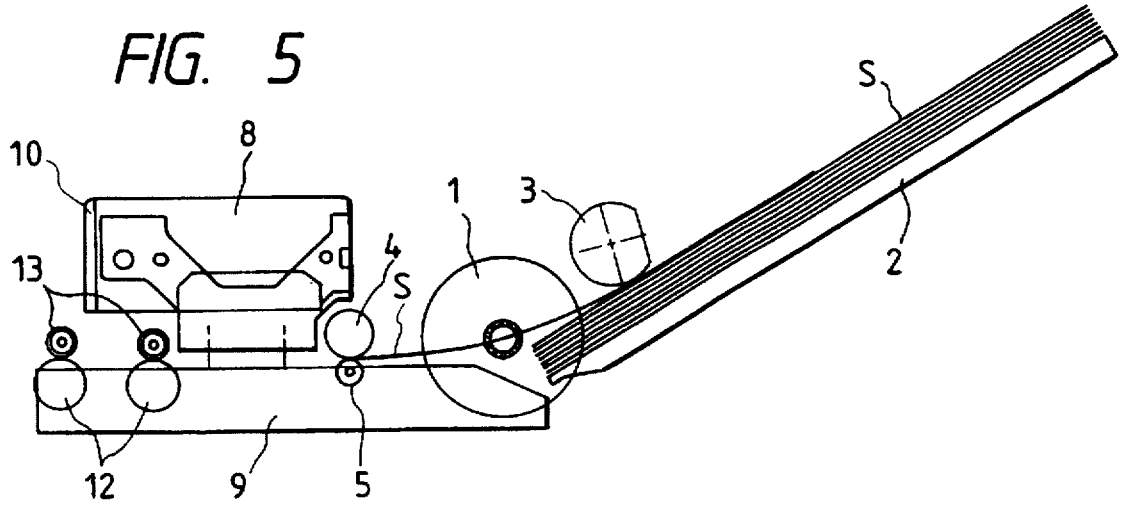
Figure 6:
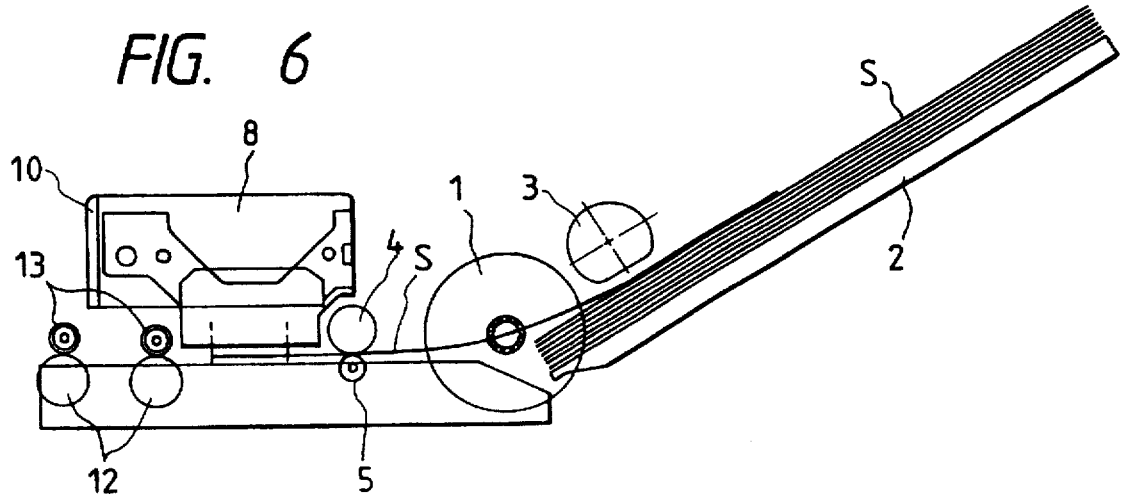

Now, a recording apparatus according to a first embodiment of the present invention will be explained with reference to the accompanying drawings. In this embodiment, the present invention is applied to an ink jet recording apparatus. FIG. 1 is a sectional view of an ink jet recording apparatus, FIGS. 2 and 3 are views for explaining a driving force transmitting mechanism, and FIGS. 4 to 6 are views for explaining a recording operation.

First of all, a schematic construction of the ink jet recording apparatus will be explained with reference to FIG. 1. In FIG. 1, a motor (drive source) 1 serves to convey a sheet (recording material) and to perform a recovery operation for a recording head, which will be described later. Sheets are stacked on a pressure plate 2 and are separated and conveyed one by one from an uppermost one by means of a sheet supply roller 3. A convey means is constituted by a convey roller 4, and a pinch roller 5 urged against the convey roller 4. The pinch roller 5 is held by a pinch roller guide 6 and is urged against the convey roller 4 by a pinch roller spring 7.

A recording head 8 acting as a recording means serves to record an ink image on the sheet conveyed by the pair of convey rollers 4, 5. In this apparatus, the recording head is a recording head of ink jet recording type wherein the ink image is recorded on the sheet by discharging ink from discharge openings of the recording head. That is to say, the recording head includes fine liquid discharge openings (orifices), liquid passages, energy acting portions arranged in the respective liquid passages, and energy generating means for generating liquid droplet forming energy applied to the liquid on the corresponding energy acting portion.

As such an energy generating means, an energy generating means using an electrothermal converter such as a piezo-electric element, or an energy generating means wherein liquid is discharged under the action of heat generated by illumination of electromagnetic wave such as laser, or an energy generating means wherein liquid is discharged by heating the liquid by an electrothermal converter such as a heating element having a heating resistor may be used.

In a recording head used with an ink jet recording apparatus wherein ink is discharged by utilizing thermal energy, since the ink discharge openings (orifices) for discharging the ink to form ink droplet can be arranged with high density, it is possible to achieve the recording with high reserving power. Among the ink jet recording heads, recording heads utilizing the electrothermal converters as the energy generating means can easily be made compact, can make use of the advantages of IC techniques and micro-working techniques which have been remarkably progressed in the recent semi-conductor field and which have high reliability, can easily be mounted with high density and can be made cheaper.

Further, since the recording head 8 has generally fine discharge openings arranged side by side, if bubble or dust is entered into the discharge opening or if viscosity of ink is increased by vaporization of ink solvent to make the ink discharge or recording impossible, a discharge recovery treatment for removing the discharge preventing factors can be effected. The recovery treatment for the recording head 8 is performed by the motor 1 which also controls the conveying operation for the sheet S.

A platen 9 opposed to the recording head 8 serves to support a rear (back) surface of the sheet at a recording station. The recording head 8 is mounted on a carriage 10 which can be reciprocally shifted along a guide shaft 11 extending in a direction transverse to the sheet S. Discharge roller 12 cooperates with spurs 13 to convey the sheet on which the image was formed. The spurs 13 are urged against the corresponding discharge roller to be driven by rotational movement of the discharge roller and are made of material to which the ink is not adhered when the spurs are contacted with the imaged surface of the sheet.

Explaining a recording operation, the sheet S separated and supplied by the sheet supply roller 3 is sent to the pair of convey rollers 4, 5 and then the heading of the sheet to a recording start position on the platen 9 is performed by the pair of convey rollers 4, 5. Then, by activating the recording head 8 in response to image information while reciprocally shifting the carriage 10 along the guide shaft 11 (main scan), the ink droplets are discharged onto the sheet to form an image. After one-line of the image is recorded by shifting the recording head 8, the sheet S is conveyed by a predetermined amount (for example, up to a next line) by driving the pair of convey rollers 4, 5. Then, the next one-line of the image is recorded by activating the recording head 8 while reciprocally shifting the carriage 10. By repeating the recording operation and the sheet conveying operation alternately, the entire image is formed on the sheet S. The sheet on which the image was recorded is discharged out of the apparatus by means of the discharge rollers 12 and the spurs 13.

Next, in the recording apparatus, a drive transmitting mechanism for transmitting a driving force from the motor 1 to the sheet supply roller 3 and the convey roller 4 will be explained with reference to FIGS. 2 and 3. In FIGS. 2 and 3, a convey roller drive double gear 14 serves to transmit a driving force to the convey roller 4. The convey roller drive double gear 14 is meshed with a gear 1*a* of the motor 1 and a convey gear 15 press-fitted on a shaft of the convey roller 4, respectively. An ASF drive double gear 16 for transmitting the driving force to an ASF (automatic sheet feeder) including the sheet supply roller 3 is meshed with the convey roller drive double gear 14. A sun gear 17 has a large diameter gear portion and a small diameter gear portion. A reverse rotation planetary gear 18 is meshed with the small diameter gear portion of the sun gear 17 to revolve around it. A normal rotation planetary gear 19 is meshed with the ASF drive double gear 16 to revolve around the double gear 16 (as a sun gear).

Next, explaining operations of the gears, in FIG. 2, when the motor 1 is rotated in a direction shown by the arrow b (reverse rotation), the convey roller 4 is rotated in a direction opposite to a sheet conveying direction via the convey roller drive double gear 14 and the convey gear 15. In this case, the associated gears are rotated in directions shown by the respective arrows in FIG. 2. That is to say, the reverse rotation planetary gear 18 is revolved around the sun gear 17 from a position shown by the broken line toward a position shown by the solid line in the direction shown by the arrow until it is engaged by a sheet supply gear 3*a* secured to a shaft of the sheet supply roller 3 and having a notched portion (non-toothed portion) 3*b*. As a result, the sheet supply roller 3 is rotated in the direction shown by the arrow (direction that the sheets S stacked on the pressure plate 2 are shifted toward the pair of convey rollers 4, 5).

Further, since the speed of the motor 1 is greatly decreased until the driving force of the motor 1 is transmitted to the reverse rotation planetary gear 18, a revolution angle of the reverse rotation planetary gear 18 for not transmitting a driving force for effecting the recovery treatment of the recording head 8 can be reduced. In this case, since the normal rotation planetary gear 19 was already revolved around the ASF drive double gear 16 from a position shown by the broken line toward a position shown by the solid line to be abutted against a stopper (not shown) (i.e., since the planetary gear 19 was stopped), the normal rotation planetary gear 19 is not engaged with the sheet supply gear 3*a*, thus not affecting an influence upon the rotation of the sheet supply roller 3.

On the other hand, in FIG. 3, when the motor 1 is rotated in a direction shown by the arrow f (normal rotation), the convey roller 4 is rotated in the sheet conveying direction via the convey roller drive double gear 14 and the convey gear 15. In this case, the associated gears are rotated in directions shown by the respective arrows in FIG. 3. That is to say, the normal rotation planetary gear 19 is revolved around the ASF drive double gear 16 from a position shown by the broken line toward a position shown by the solid line until it is engaged by the sheet supply gear 3*a* secured to the shaft of the sheet supply roller 3. As a result, the sheet supply roller 3 is rotated in the direction shown by the arrow (direction that the sheets S stacked on the pressure plate 2 are shifted toward the pair of convey rollers 4, 5).

Further, since the speed of the motor 1 is not so decreased until the driving force of the motor 1 is transmitted to the normal rotation planetary gear 19, as soon as the rotational direction of the motor 1 is changed from the reverse direction to the normal direction, the normal rotation planetary gear 19 is engaged by the sheet supply gear 3*a*. In this case, since the reverse rotation planetary gear 18 was already revolved around the sun gear 17 from a position shown by the broken line toward a position shown by the solid line to be abutted against a stopper (not shown) (i.e., since the planetary gear 18 was stopped), the reverse rotation planetary gear 18 is not engaged with the sheet supply gear 3*a*, thus not affecting an influence upon the rotation of the sheet supply roller 3.

Next, a sheet conveying operation effected by using the drive transmitting mechanism will be explained with reference to FIGS. 4 to 6. As shown in FIG. 4, the sheet supply roller 3 has a semi-circular (D-shaped) cross-section and is normally waiting in a condition that a cut-out (flat portion) of the sheet supply roller is opposed to the pressure plate 2. In this condition, the sheets S are set on the pressure plate 2.

When the motor 1 is rotated in the reverse direction, the reverse rotation planetary gear 18 is engaged by the sheet supply gear 3*a*, thereby rotating the sheet supply roller 3 in the direction shown by the arrow in FIG. 2. When the sheet supply roller 3 is rotated, an uppermost sheet S is separated from the other sheets, and the separated sheet is abutted against a nip between the pair of convey rollers 4, 5, thereby correcting the skew-feed of the sheet. The sheet supply roller 3 is rotated by an amount sufficient to abut the sheet S against the nip between the pair of convey rollers 4, 5, and the rotational angle of the sheet supply roller 3 is controlled by the notched portion 3*b* of the sheet supply gear 3*a*. That is to say, as shown in FIG. 5, when the sheet supply roller 3 is rotated by a predetermined angle, since the notched portion 3*b* is brought to a position where it is opposed to the reverse rotation planetary gear 18, the sheet supply roller 3 is stopped, so that a tip end of the uppermost sheet S is abutted against the nip between the pair of convey rollers 4, 5.

When the rotational direction of the motor 1 is changed from the reverse direction to the normal direction, the sheet S abutted against the nip between the pair of convey rollers 4, 5 is guided up to the predetermined recording station by the normal rotation of the convey roller 4. In this case, as mentioned above, since the normal rotation planetary gear 19 is revolved at the position where the speed of the motor 1 is not so decreased, the sheet supply roller 3 is rotated in the sheet conveying direction immediately after the motor 1 is rotated. Accordingly, as shown in FIG. 6, since the sheet S abutted against the nip between the pair of convey rollers 4, 5 is pushed into the nip by the sheet supply roller 3 immediately after the convey roller 4 is rotated, the heading of the sheet to the recording station can surely be performed. Then, when the sheet supply roller 3 is rotated to the waiting position shown in FIG. 3, since the notched portion 3*b* is brought to a position where it is opposed to the normal rotation planetary gear 19, the sheet supply roller 3 is stopped.

By repeating the main scan of the recording head 8 and the sub-scan of the convey roller 4 alternately, the image is formed on the sheet S at the recording station. Thereafter, the sheet is discharged out of the apparatus by means of the discharge rollers 12 and the spurs 13.

With the arrangement as mentioned above, in the drive transmitting mechanism wherein the sheet supply roller 3 is rotated in the sheet conveying direction regardless of the rotational direction of the motor 1, since the reverse rotation planetary gear 18 (operated when the motor 1 is rotated in the reverse direction) is revolved at the position where the speed of the motor 1 is greatly decreased, the revolution angle of the normal rotation planetary gear 19 for preventing the transmission of the driving force for effecting the recovery treatment for the recording head 8 to the sheet supply roller 3 can be reduced.

Further, since the normal rotation planetary gear 19 (operated when the motor 1 is rotated in the normal direction) is revolved at the position where the speed of the motor 1 is not so decreased, the heading amount of the sheet S can be surely stabilized.

Next, the recovery treatment for the recording head 8 will be explained with reference to FIG. 8.

The carriage 10 is driven by the motor 1, a pulley 52 secured to an output shaft of the motor 1, and a belt 53 mounted around the pulley 52 and having one end connected to the carriage 10.

A cap 40 for covering an ink discharge opening surface 8*a* of the recording head 8 is mounted on a cap support 41 which has a rotary shaft 41*a* and a push-down cam portion 41*b*. Since the cap support 41 is biased by a spring 42 to be rotated around the rotary shaft 41*a* in an anti-clockwise direction, when a projection 10*a* of the carriage 10 is abutted against the push-down cam 41*b* as the carriage 10 is shifted, the cap support 41 is lowered in opposition to a biasing force of the spring 42, with the result that the cap 40 is also lowered. When the projection 10*a* is passed through the push-down cam 41*b*, the cap 40 is lifted to closely contacting with the discharge opening surface 8*a*, thereby covering the discharge openings.

A pump 43 has a piston shaft 43*b* on which a rack 43*a* is formed, a suction opening 43*c*, and an outlet opening 43*d*. The suction opening 43*c* is connected to the cap 40 through a tube 40*a* and the outlet opening 43*d* is connected to a tank 50 disposed below the platen 9 through a tube 44 so that the ink from the cap 40 is discharged onto an ink absorbing material in the tank 50.

Figure 7:
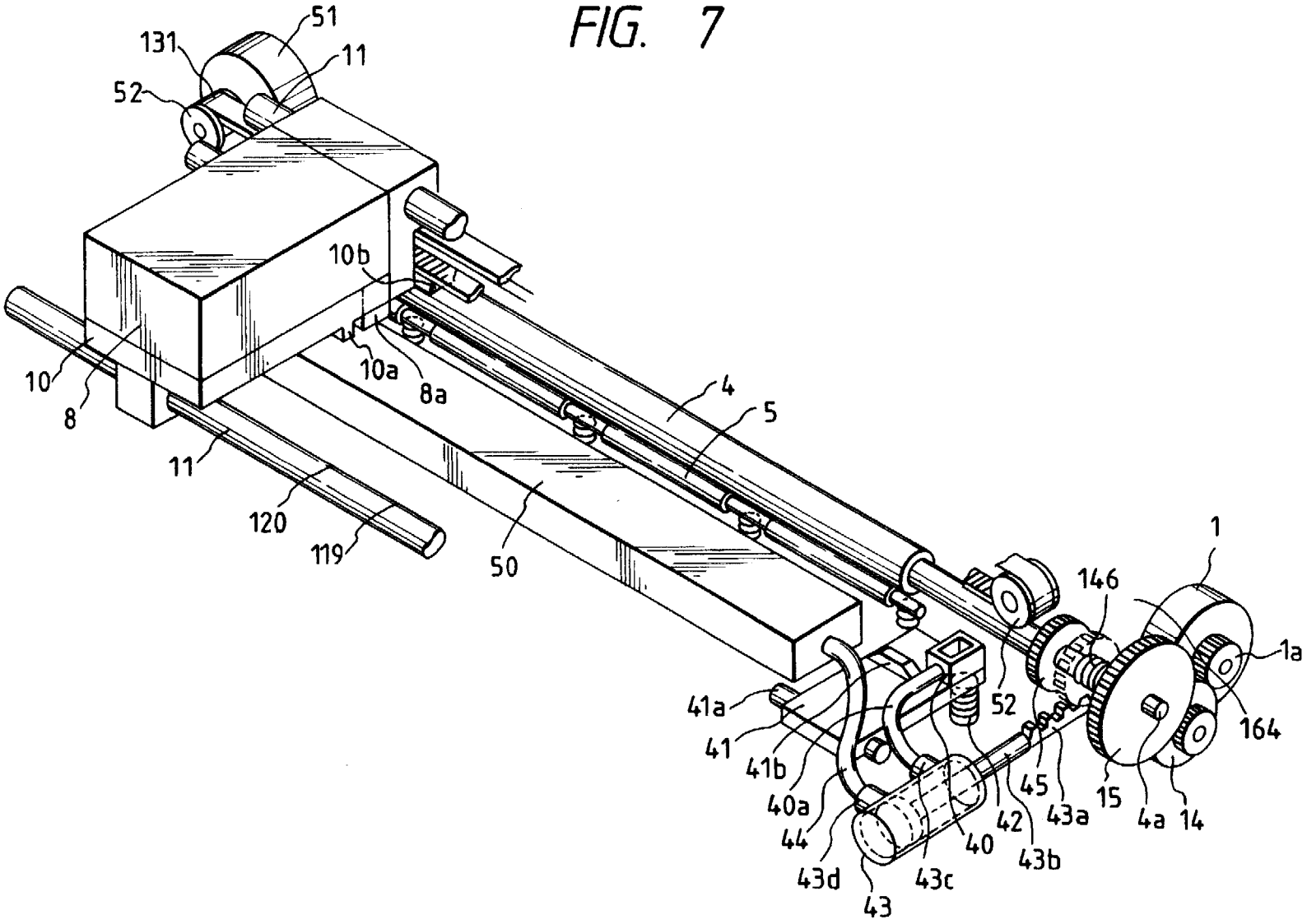
FIG. 7 is a perspective view of a recording portion.

A pump drive gear 45 is arranged on the shaft 4*a* of the convey roller 4 so that it can be shifted along the shaft 4*a* and be rotated together with the shaft 4*a*. Further, the pump drive gear 45 is normally maintained by a spring 46 at a position where it is not engaged by the rack 43*a*. Solid component of the ink is apt to adhere to the discharge opening surface 8*a*, thereby causing the poor ink discharge. If such a condition occurs, in order to perform the recovery treatment of the recording head, a motor 51 is activated in response to the command from a controller to shift the carriage 10, thereby contacting the cap 40 with the discharge opening surface 8*a*. By the shifting movement of the carriage 10, the projection 10*a* of the carriage 10 shifts the pump drive gear 45 to a position shown by the broken line in FIG. 7, thereby engaging the gear 45 by the rack 43*a*. In this condition, when the gear 45 is rotated in the normal direction and the reverse direction alternately by predetermined times within a predetermined angular range, the rack 43*a* is recoprocally shifted along a straight direction by the predetermined times. Since a piston is reciprocally shifted in synchronous with the movement of the piston shaft 43*b*, the pump 43 absorbs the ink and solid component thereof from the discharge openings in the discharge opening surface 8*a*, and the absorbed matters are discharged onto the absorbing material in the tank 50.

In the recovery treatment, even when the motor 1 is rotated in the normal direction, since the notched portion 3*b* of the sheet supply gear 3*a* is opposed to the normal rotation planetary gear 19, the sheet supply roller 3 is maintained at the waiting condition, and, thus, is not rotated. Further, since the reverse rotation of the motor 1 is effected within the range that the reverse rotation planetary gear 18 is not engaged by the sheet supply gear 3*a*, the sheet supply roller 3 is not rotated. Since the reverse rotation planetary gear 18 (and the sun gear 17) is rotated at the position where the speed of the motor 1 is greatly decreased, there is a great angular range within which the motor 1 can be rotated in the reverse direction without the engagement between the reverse rotation planetary gear 18 and the sheet supply gear 3*a*.

Next, a recording apparatus according to a second embodiment of the present invention will be explained with reference to FIGS. 8 and 9. Incidentally, since a schematic construction of this recording apparatus is the same as that of the first embodiment, the same elements as those of the first embodiment are designated by the same reference numerals and explanation thereof will be omitted, and characteristic portions of the second embodiment will be mainly described.

In this second embodiment, the drive transmitting mechanism has a plurality of planetary gears one of which acts as a sun gear. That is to say, in FIGS. 8 and 9, there is provided a normal rotation planetary gear 20 revolved around the gear 1*a* of the motor 1 as a sun gear. The normal rotation planetary gear 20 has a large diameter gear portion and a small diameter gear portion 20*a*. A reverse rotation planetary gear 21 is revolved around the small diameter gear portion 20*a* of the normal rotation planetary gear 20 as a sun gear. Accordingly, the driving force of the motor 1 (regarding the ASF) is transmitted to the sheet supply roller 3 through the normal rotation planetary gear 20 and the reverse rotation planetary gear 21. Incidentally, since the transmission of the driving force to the convey roller 4 is the same as that of the first embodiment, explanation thereof will be omitted.

Figure 8:
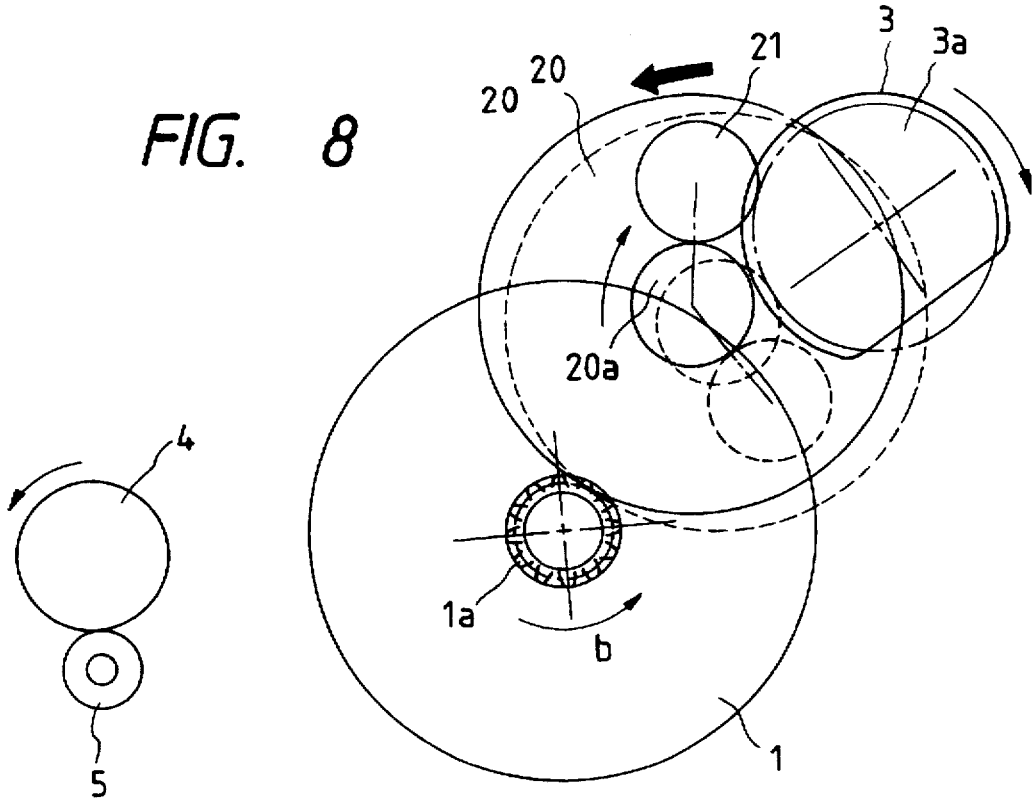
FIGS. 8 and 9 are views for explaining a driving force transmitting mechanism according to a second embodiment.

Next, explaining operations of the gears, in FIG. 8, when the motor 1 is rotated in a direction shown by the arrow b (reverse rotation), as is in the first embodiment, the convey roller 4 is rotated in a direction opposite to the sheet conveying direction (reverse direction) via the convey roller drive double gear 14 and the convey gear 15. In this case, the normal rotation planetary gear 20 is revolved around the gear 1*a* from a position shown by the broken line to a position shown by the solid line in a direction shown by the arrow until it is abutted against a stopper (not shown), so that the normal rotation planetary gear is stopped at a position where it is positioned near the sheet supply gear 3*a* but where it is not interfered with the sheet supply gear 3*a*. On the other hand, the reverse rotation planetary gear 21 is revolved around the normal rotation planetary gear 20 from a position shown by the broken line to a position shown by the solid line in a direction shown by the arrow until it is engaged by the sheet supply gear 3*a* of the sheet supply roller 3. As a result, the sheet supply roller 3 is rotated in a direction shown by the arrow (i.e., a direction that the sheets S stacked on the pressure plate 2 are shifted toward the pair of convey rollers 4, 5).

Further, since the speed of the motor 1 is greatly decreased until the driving force of the motor is transmitted to the reverse rotation planetary gear 21, the revolution angle of the reverse rotation planetary gear 21 for preventing the transmission of the driving force for effecting the recovery treatment for the recording head 8 to the sheet supply roller 3 can be reduced.

Figure 9:
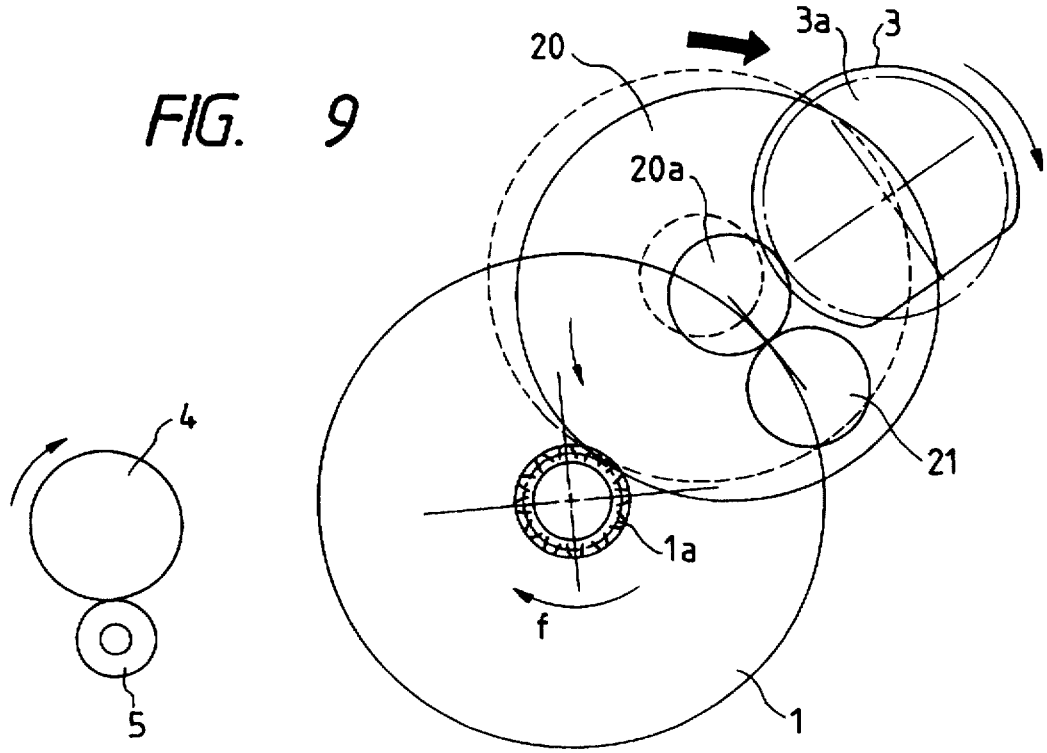

On the other hand, in FIG. 9, when the motor 1 is rotated in a direction shown by the arrow f (normal rotation), as is in the first embodiment, when the motor 1 is rotated in a direction shown by the arrow f (normal rotation), the convey roller 4 is rotated in the sheet conveying direction (normal direction) via the convey roller drive double gear 14 and the convey gear 15. In this case, the normal rotation planetary gear 20 is revolved around the gear 1*a* from a position shown by the broken line toward a position shown by the solid line until the small diameter gear portion 20*a* is engaged by the sheet supply gear 3*a* of the sheet supply roller 3. As a result, the sheet supply roller 3 is rotated in the direction shown by the arrow (direction that the sheets S stacked on the pressure plate 2 are shifted toward the pair of convey rollers 4, 5).

Since the normal rotation planetary gear 20 is engaged by the gear 1*a* of the motor 1, immediately after the rotational direction of the motor 1 is changed from the reverse direction to the normal direction, the sheet supply roller 3 is rotated. Consequently, when the rotational direction of the convey roller 4 is changed from the reverse direction to the normal direction, the sheet S abutted against the nip between the pair of convey rollers 4, 5 is pushed from the rear side by the sheet supply roller 3 substantially at the same time when the sheet is conveyed to the recording station. Thus, the predetermined heading amount of the sheet can be achieved, even regarding a thick sheet such as an envelope, a post card or the like. Further, in this case, since the reverse rotation planetary gear 21 was already revolved around the normal rotation planetary gear 20 in the direction shown by the arrow to reach the position shown by the solid line, thereby abutting against the stopper (not shown) (i.e., since the planetary gear 21 was stopped), the reverse rotation planetary gear 21 is not engaged with the sheet supply gear 3*a*, thus not affecting an influence upon the rotation of the sheet supply roller 3.

Figure 10:
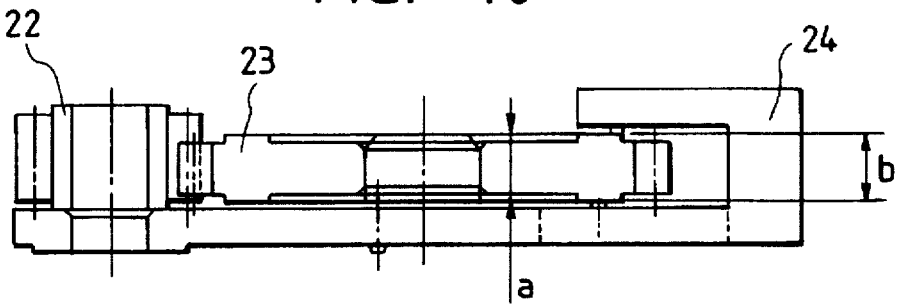
FIG. 10 is a view for explaining a driving force transmitting mechanism according to a third embodiment.

Next, a recording apparatus according to a third embodiment will be explained with reference to FIG. 10. Incidentally, since a schematic construction of this recording apparatus is the same as that of the first embodiment, the same elements as those of the first embodiment are designated by the same reference numerals and explanation thereof will be omitted, and characteristic portions of the third embodiment will be mainly described.

According to this third embodiment, in a drive transmitting mechanism, a friction force for regulating rotation of a planetary gear is applied by utilizing elasticity of a resin member (mounted in coaxial with a sun gear and) having a holding portion for holding the planetary gear. That is to say, in FIG. 10, a planetary gear 23 is meshed with a sun gear 22 (for transmitting a driving force of a drive source such as a motor (not shown)) to revolve around the sun gear. An arm 24 for holding the planetary gear 23 is made of resin material so that a friction force is applied to a side surface of the planetary gear 23 by utilizing elasticity of the arm. The arm 24 is attached to a shaft (not shown) to which the sun gear 22 is secured. A thickness a of a portion of the planetary gear 23 sandwiched between the arm portions 24 is slightly greater than a distance b between the arm portions sandwiching the planetary gear 23 (a>b) so that a moderate friction force is applied to the planetary gear 23, with the result that the planetary gear can be revolved around the sun gear 22, thereby surely effecting the transmission of the driving force.

Figure 11A:
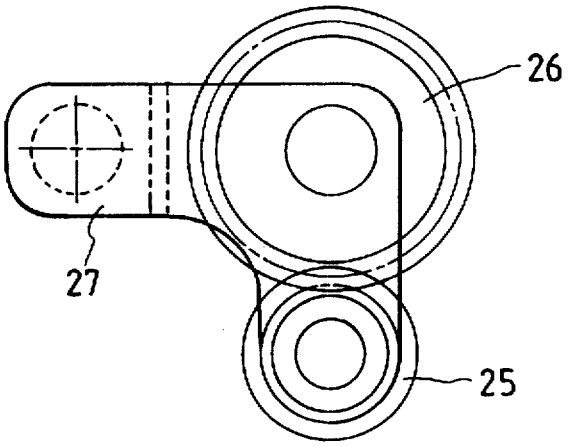
FIGS. 11A and 11B are views for explaining a driving force transmitting mechanism according to a fourth embodiment.

Next, a recording apparatus according to a fourth embodiment will be explained with reference to FIGS. 11A and 11B. Incidentally, since a schematic construction of this recording apparatus is the same as that of the first embodiment, the same elements as those of the first embodiment are designated by the same reference numerals and explanation thereof will be omitted, and characteristic portions of the fourth embodiment will be mainly described.

This embodiment is an alteration of the third embodiment. Thus, also in a drive transmitting mechanism according to this embodiment, a friction force is applied to a planetary gear by utilizing elasticity of a resin member mounted in coaxial with a sun gear. That is to say, in FIG. 11A, a planetary gear 26 is meshed with a sun gear 25 (for transmitting a driving force of a drive source such as a motor (not shown)) to revolve around the sun gear. An arm 27 for holding the planetary gear 23 is made of resin material such as plastics so that a friction force is applied to a side surface of the planetary gear 26 by utilizing elasticity of the arm. The arm 27 is attached to a shaft (not shown) to which the sun gear 25 is secured and has a structure for sandwiching the planetary gear 26. A dimensional relation between the arm 27 and the planetary gear 26 is the same as that of the third embodiment. With this arrangement, the friction force can positively be applied to the planetary gear 26, and, since the planetary gear is sandwiched by the arm from both sides, when the planetary gear is engaged by another gear, the planetary gear is prevented from being laid.

Figure 11B:
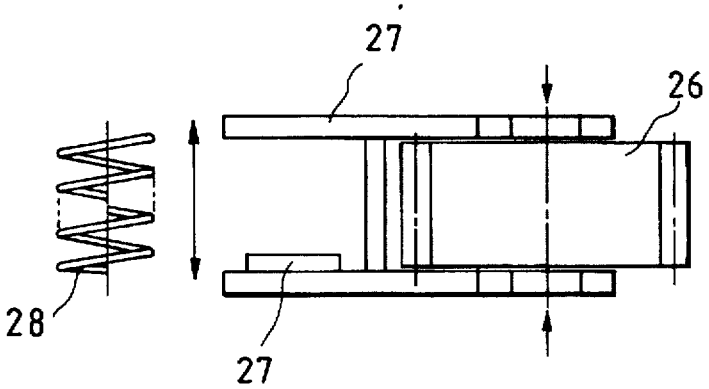

Further, as shown in FIG. 11B, a compression spring 28 may be seated on a spring seat 27*a* between the arm portions. In this case, since a biasing force of the spring acts toward directions shown by the double-headed arrow, a greater force for pinching the planetary gear 26 is applied to the arm 27, thereby pinching the planetary gear and applying the friction force to the planetary gear more positively. Since the compression spring 28 is housed between the arm portions, it is not required for providing an additional installation space for the compression spring.

Figure 12A:
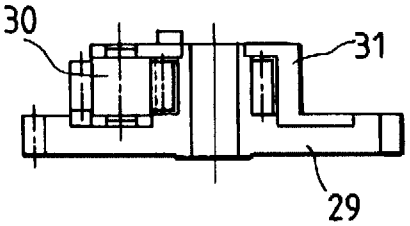
FIGS. 12A to 12C are views for explaining a driving force transmitting mechanism according to a fifth embodiment.

Next, a recording apparatus according to a fifth embodiment of the present invention will be explained with reference to FIGS. 12A to 12C. Incidentally, since a schematic construction of this recording apparatus is the same as that of the first embodiment, the same elements as those of the first embodiment are designated by the same reference numerals and explanation thereof will be omitted, and characteristic portions of the fifth embodiment will be mainly described.

This embodiment is a further alteration of the third embodiment. Thus, also in a drive transmitting mechanism according to this embodiment, a friction force is applied to a planetary gear by utilizing elasticity of a resin member (mounted in coaxial with a sun gear and) having a holding portion for holding the planetary gear. That is to say, in FIG. 12A, a planetary gear 30 is meshed with a sun gear 29 (for transmitting a driving force of a drive source such as a motor (not shown)) to revolve around the sun gear. An arm 31 for holding the planetary gear 30 is made of resin material such as plastics so that a friction force is applied to a side surface of the sun gear 29 by utilizing elasticity of the arm. The arm 31 is fitted in the side surface of the sun gear 29, and the planetary gear 30 is sandwiched between portions of the arm from both sides.

Figure 12B:
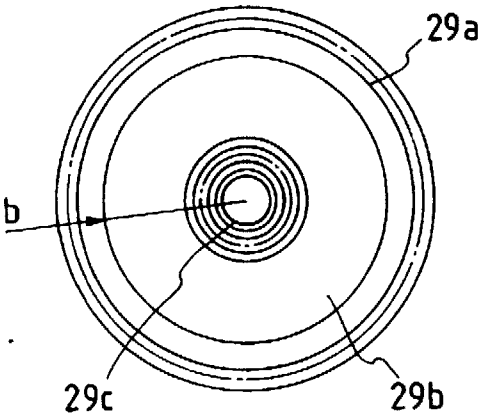
Figure 12C:
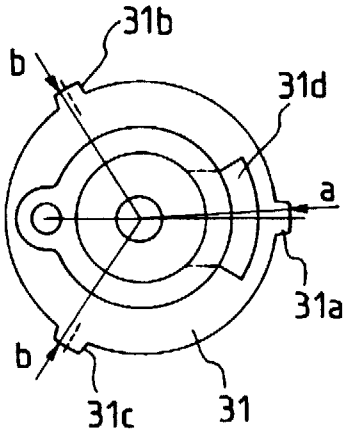

As shown in FIG. 12B, the sun gear is provided at its periphery with a gear portion 29*a* for transmitting a driving force and is also provided at its one side surface with a groove 29*b* into which the arm 31 is fitted. The sun gear 29 has a central hole 29*c* into which a rotary shaft is fitted. Further, as shown in FIG. 12C, three projections 31*a*, 31*b*, 31*c* are formed on the periphery of the arm 31. When the arm 31 is fitted into the groove 29*b* of the sun gear, these projections are abutted against an outer peripheral surface of the groove 29*b*. A radius a of the projection 31*a* is greater than a radius b of the groove 29*b* (a>b) and radii of the projections 31*b*, 31*c* are the same as the radius b of the groove 29*b*. A hole 31*d* is formed in the arm 31 at a position inside of the projection 31*a* so that, when the arm 31 is fitted into the groove 29*b* of the sun gear 29, the hole 31*d* is deformed to cause friction between the projection 31*a* and the outer wall of the groove 29*b*. Further, the planetary gear 30 is held by the arm 31 in such a manner that both surfaces of the planetary gear are pinched between the arm portions. With this arrangement, the friction force is positively applied to the arm 31, thereby rotating the arm together with the sun gear 29 while holding the planetary gear 30.

Figure 13:
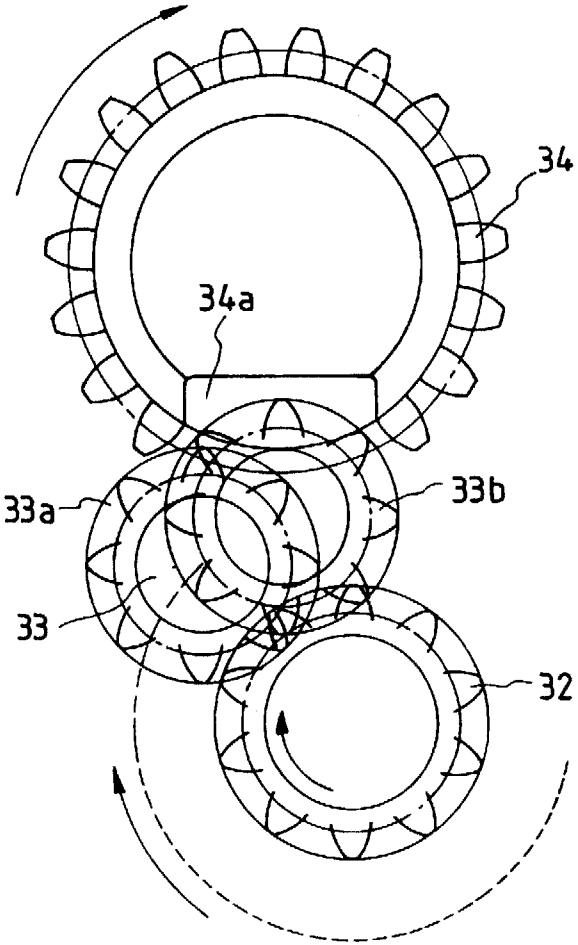
FIG. 13 is a view for explaining a driving force transmitting mechanism according to a sixth embodiment.

Next, a recording apparatus according to a sixth embodiment of the present invention will be explained with reference to FIG. 13. Incidentally, since a schematic construction of this recording apparatus is the same as that of the first embodiment, the same elements as those of the first embodiment are designated by the same reference numerals and explanation thereof will be omitted, and characteristic portions of the sixth embodiment will be mainly described.

According to this embodiment, in a drive transmitting mechanism, a planetary gear is revolved from an engagement position where the planetary gear is engaged by a gear to a notched position where the planetary gear is not engaged by any gear. That is to say, in FIG. 13, a planetary gear 33 is meshed with a sun gear 32 (for transmitting a driving force of a drive source such as a motor (not shown)) to revolve around the sun gear. A pick-up gear 34 serves to transmit a driving force to the sheet supply roller 3 and has a notched portion (non-toothed portion) 34*a*. When the sun gear 32 is rotated in a direction shown by the arrow in FIG. 13 by the driving force from the drive source, the planetary gear 33 is revolved around the sun gear 32 in a direction shown by the arrow until it is engaged by the pick-up gear 34. Consequently the pick-up gear 34 is rotated in a direction shown by the arrow. When the notched portion 34*a* is encountered by the planetary gear 33, the pick-up gear 34 is stopped. The notched portion 34*a* of the pick-up gear 34 is cut into the inside of the gear portion, so that, when the notched portion 34*a* of the pick-up gear 34 reaches a position as shown, the planetary gear 33 is further revolved from an engagement position 33*a* to a non-engagement position 33*b*. Accordingly, unlike to the conventional cases, the tooth of the planetary gear 33 is not struck against an end tooth of the notched portion 34*a*, thereby preventing noise from generating.

As mentioned above, according to the present invention, in the drive transmitting mechanism wherein the sheet supply means is rotated in the sheet conveying direction regardless of the rotational direction of the drive means, since the planetary gear (operated when the drive means is rotated in the reverse direction) is revolved at the position where the speed of the drive means is greatly decreased, the revolution angle of the planetary gear for preventing the transmission of the driving force for effecting the recovery treatment for the recording head to the sheet supply roller can be reduced.

Further, since the planetary gear (operated when the drive means is rotated in the normal direction) is revolved at the position where the speed of the drive means is not so decreased, the heading amount of the sheet can surely be stabilized.

Further, when the friction is applied to the planetary gear by utilizing the elasticity of the resin member (mounted in coaxial with the sun gear and) having the holding portion for holding the planetary gear, the planetary gear can positively be revolved around the sun gear to ensure the engagement/disengagement between the planetary gear and the associated gear, and the number of parts can be reduced to save the space and to contribute to the compactness of the apparatus.

Furthermore, by revolving the planetary gear from the engagement position (with the notched gear) and the non-engagement position, the tooth of the planetary gear 33 is not struck against an end tooth of the notched portion 34*a*, thereby preventing noise from generating.

Figure 14:
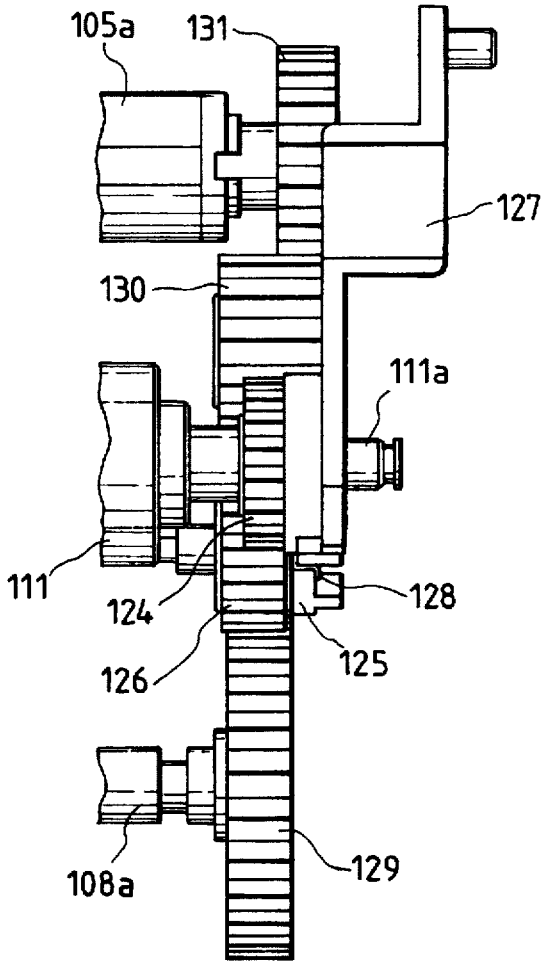
FIG. 14 is a front view of a driving force transmitting mechanism.
Figure 15:
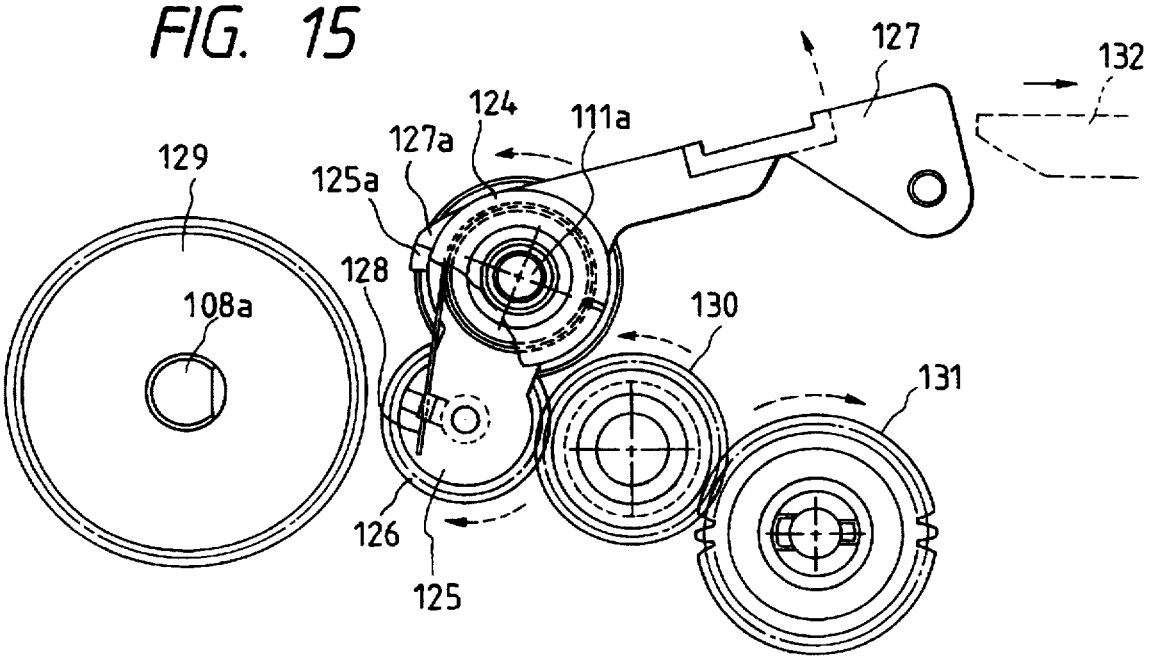
FIGS. 15 to 17 are side views of the driving force transmitting mechanism for explaining an operation thereof.
Figure 16:
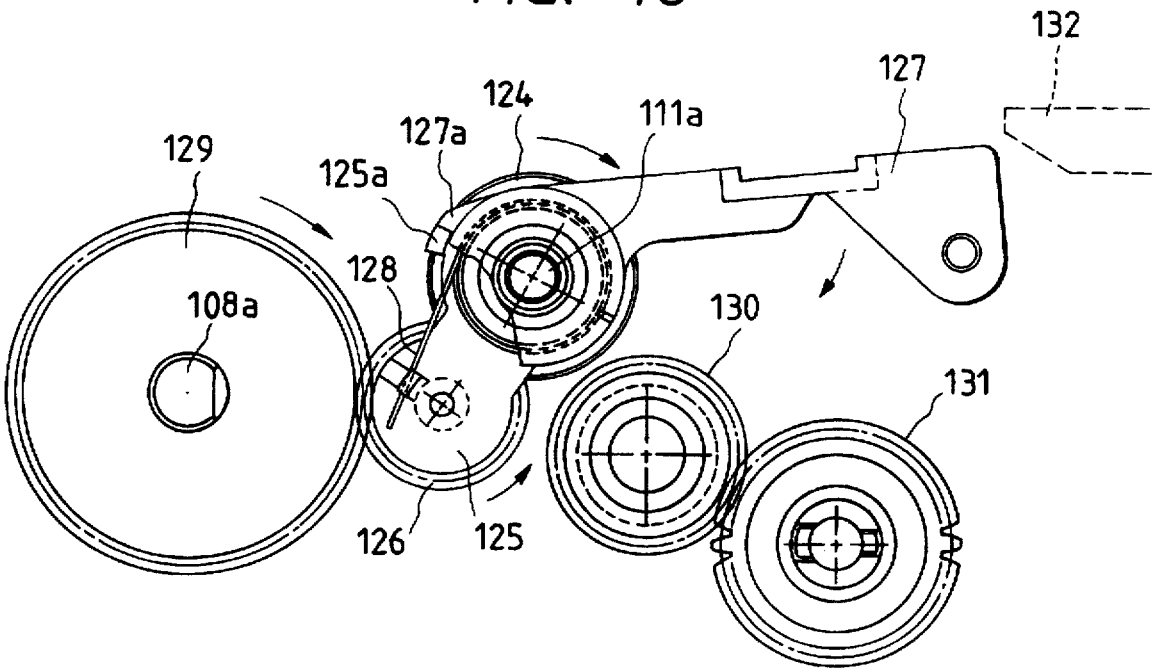
Figure 17:
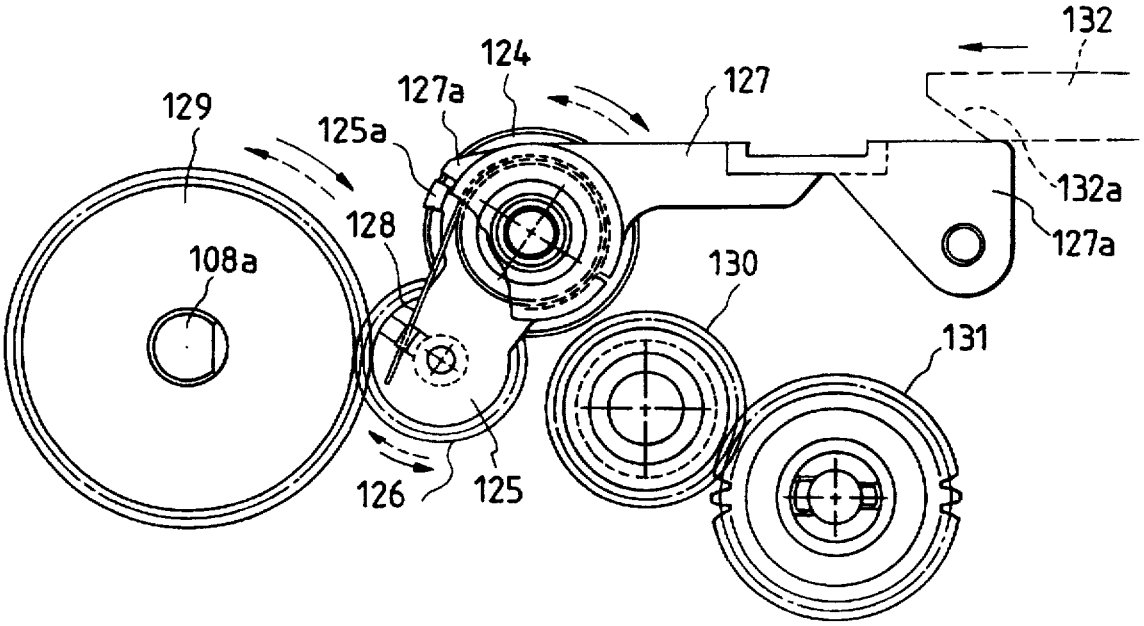
Figure 18:
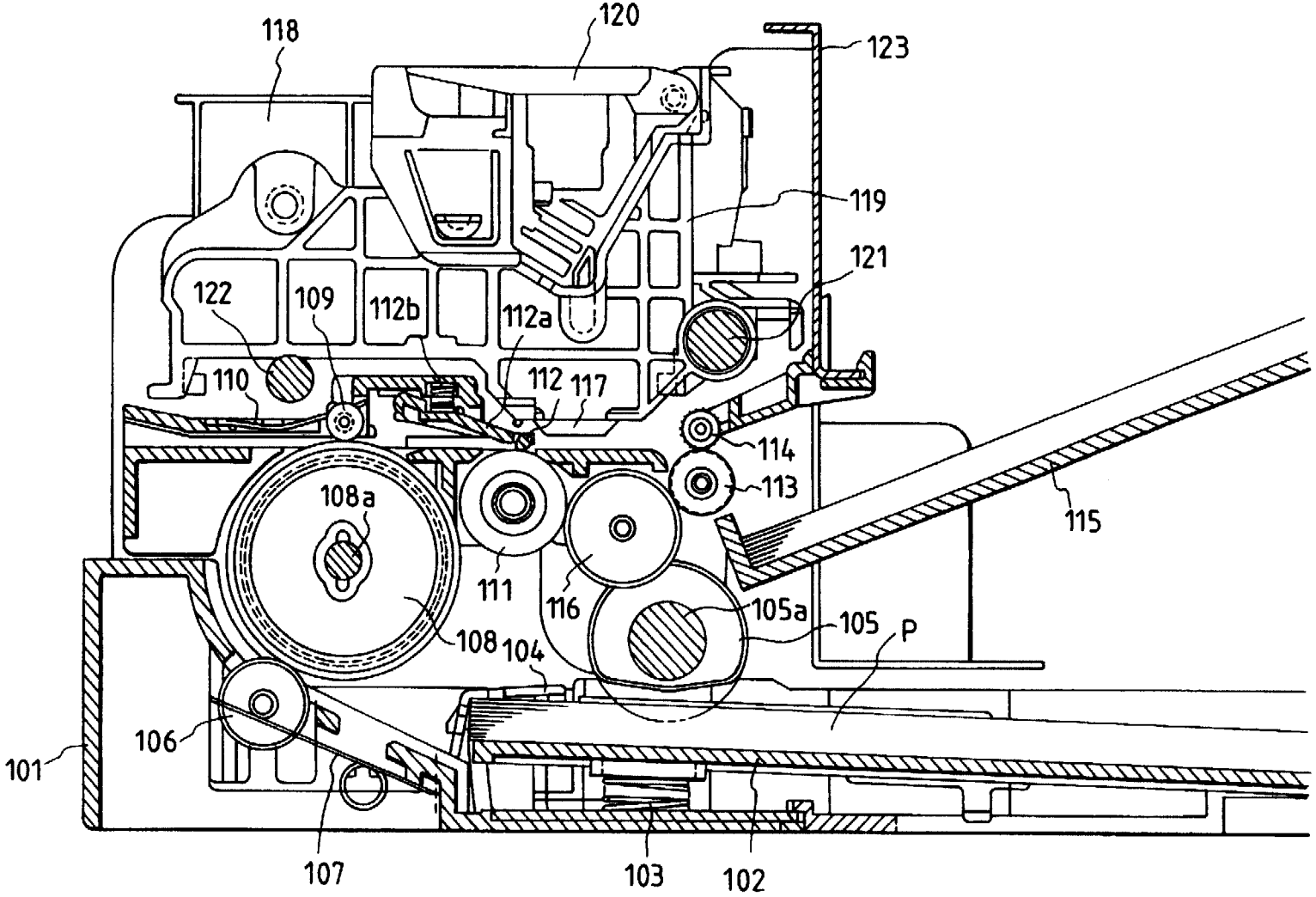
FIG. 18 is a sectional view showing a schematic construction of an ink jet recording apparatus.
Figure 19:
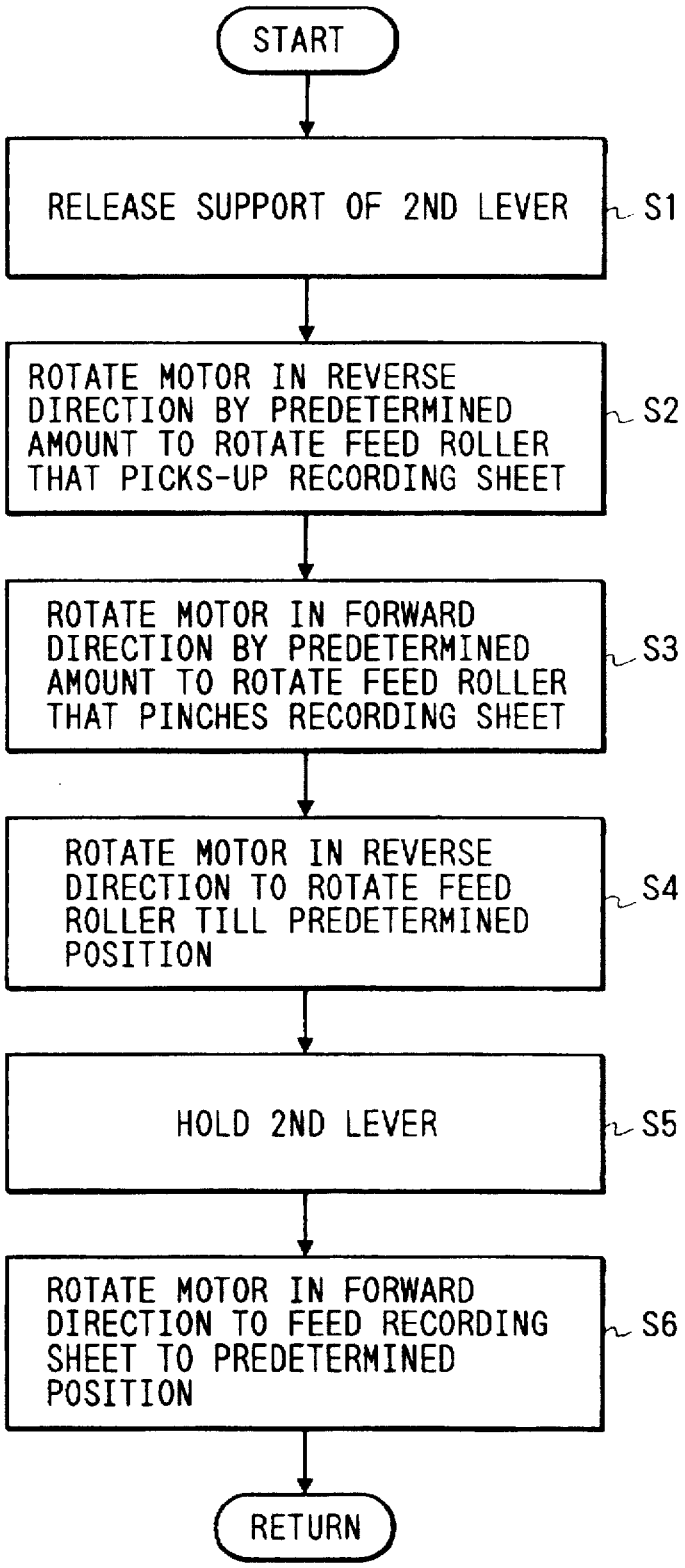
FIG. 19 is a flow chart for explaining a sheet supplying operation.
Figure 20:
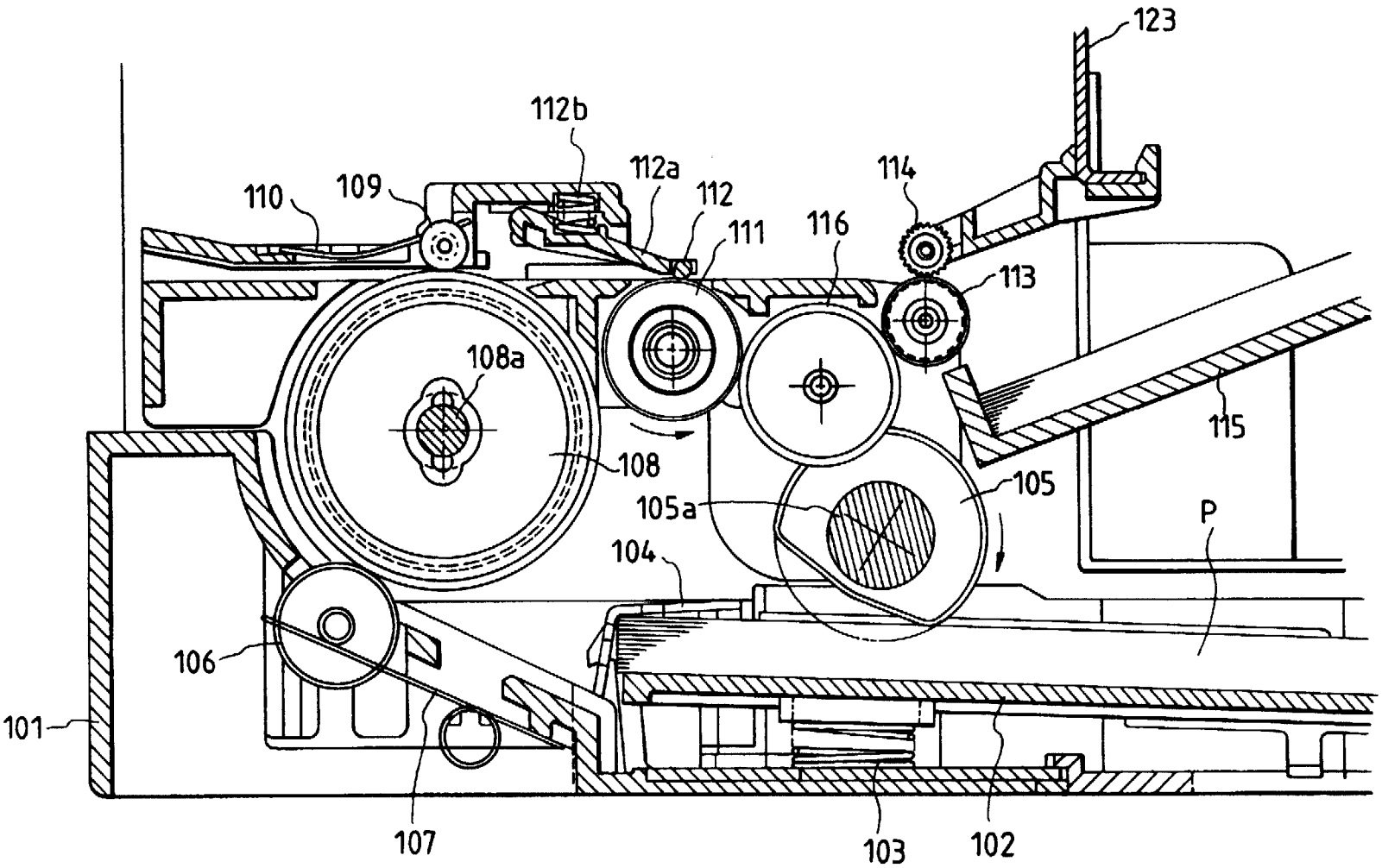
FIGS. 20 to 24 are sectional views showing recording material conveying conditions.
Figure 21:
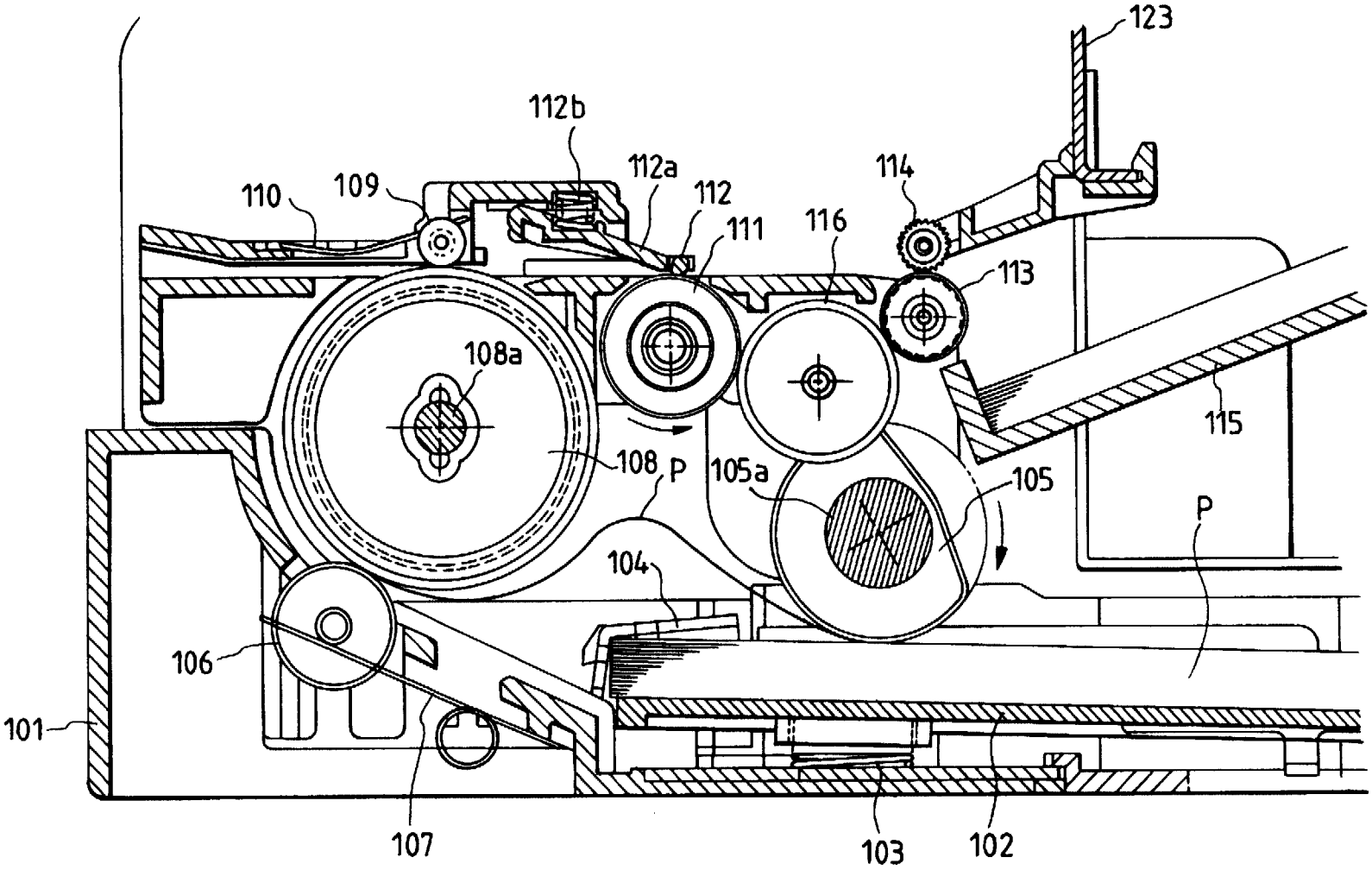
Figure 22:
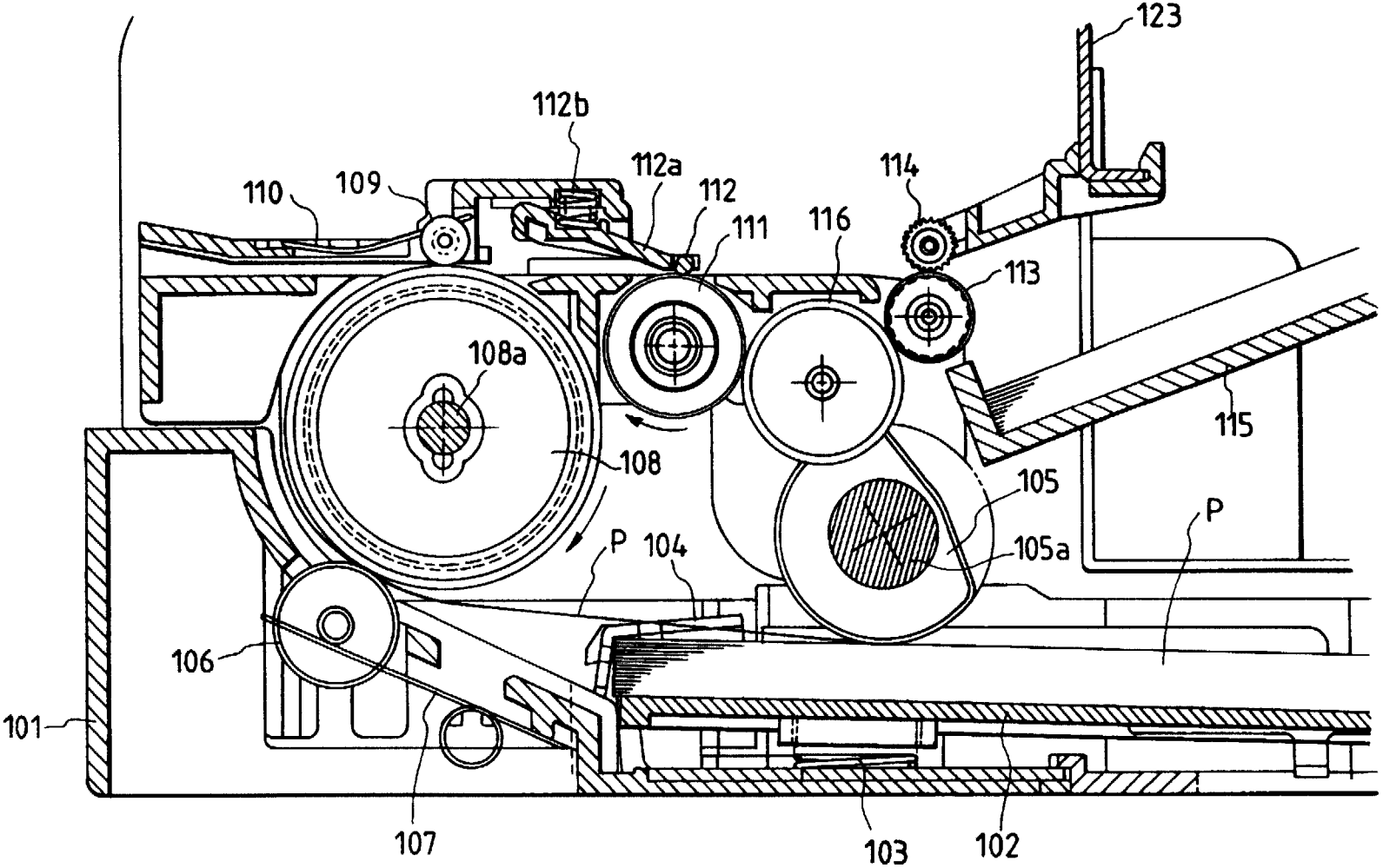

Next, a drive transmitting mechanism according to a seventh embodiment will be explained with reference to the accompanying drawings. This embodiment relates to an ink jet recording apparatus as an example of a recording apparatus having a drive transmitting mechanism. FIG. 14 is a front view of such a drive transmitting mechanism. FIGS. 15 to 17 are side views of the drive transmitting mechanism for explaining an operation thereof. FIG. 18 is a sectional view showing a schematic construction of the ink jet recording apparatus. FIG. 19 is a flow chart for explaining a sheet supplying operation, and FIGS. 20 to 24 are explanatory views showing a recording material conveying conditions.

First of all, the schematic construction of the ink jet recording apparatus will be explained with reference to FIG. 18.

In FIG. 18, recording sheets (recording materials) P are stacked on a pressure plate 102 in a sheet supply cassette 101 and the pressure plate 102 is biased upwardly by pressure plate springs at positions where the springs are opposed to a sheet supply roller 105 which will be described later. Separation pawls 104 are provided on front (in a sheet conveying direction) corners of the cassette. The sheet supply roller 105 is rotatably supported on a sheet supply roller shaft 105*a* and is disposed in an opposed relation to the recording sheets P. The sheet supply roller 105 has a semi-circular (D-shaped) cross-section having a cut-out (flat portion). In a waiting condition, the cut-out of the sheet supply roller is oriented downwardly (opposed to the recording sheets P). When the sheet supply roller is rotated, a cylindrical portion of the sheet supply roller is contacted with an uppermost recording sheet P, thereby feeding out the recording sheet. A pressure roller 106 is provided on the sheet supply cassette 101 and is biased by a leaf spring 107 to be urged against a second convey roller 108 which will be described later.

The second convey roller 108 is secured to a rotary shaft 108*a*. A driven roller 109 is urged against the second convey roller 108 by a leaf spring 110 to be driven by rotation of the second convey roller. The recording sheet P fed from the sheet supply cassette 101 is pinched between the second convey roller 108 and the pressure roller 106 to be conveyed along a peripheral surface of the second convey roller 108 and then is pinched between the second convey roller 108 and the driven roller 109 to be further conveyed downstreamly.

A first convey roller 111 serves to convey the recording sheet P to a recording station. A pinch roller 112 is held by a pinch roller holder 112*a* and is urged against the first convey roller 111 by a pinch roller spring 112. The recording sheet P conveyed by the second convey roller 108 is pinched between the first convey roller 111 and the pinch roller 112 to be conveyed to the recording station.

A discharge roller 113 serves to discharge the recording sheet P onto a discharge stacker 115. Spurs 114 are urged against the discharge roller 113 and are made of material which does not smudge the imaged surface of the recording sheet P. The recording sheet P is pinched between the discharge roller 113 and the spurs 114 to be discharged onto the discharge stacker 115. A transmission roller 116 is contacted with peripheral surfaces of the first convey roller 111 and the discharge roller 113 to transmit a rotational force of the first convey roller 111 to the discharge roller 113.

A recording means comprises a recording head 117 serving to form an ink image on the recording sheet P conveyed by the first convey roller 111 and the pinch roller 112. In this recording apparatus, the recording means is of ink jet recording head wherein ink is discharged from the recording head 117 to form the image on the recording sheet. That is to say, the recording head includes fine liquid discharge openings (orifices), liquid passages, energy acting portions arranged in the respective liquid passages, and energy generating means for generating liquid droplet forming energy applied to the liquid on the corresponding energy acting portion.

As such an energy generating means, an energy generating means using an electrothermal converter such as a piezo-electric element, or an energy generating means wherein liquid is discharged under the action of heat generated by illumination of electromagnetic wave such as laser, or an energy generating means wherein liquid is discharged by heating the liquid by an electrothermal converter such as a heating element having a heating resistor may be used.

In a recording head used with an ink jet recording apparatus wherein ink is discharged by utilizing thermal energy, since the ink discharge openings (orifices) for discharging the ink to form ink droplet can be arranged with high density, it is possible to achieve the recording with high resolving power. Among the ink jet recording heads, recording heads utilizing the electrothermal converters as the energy generating means can easily be made compact, can make use of the advantages of IC techniques and microworking techniques which have been remarkably progressed in the recent semi-conductor field and which have high reliability, can easily be mounted with high density and can be made cheaper.

An ink tank 118 serves to supply the ink to the recording head 117. The recording head 117 and the ink tank 118 are mounted on a carriage 119 which can be reciprocally shifted in a main scan direction (transverse to the recording sheet). A head cover 120 is engaged by the carriage 119 to secure the recording head 117 and the ink tank 118 to the carriage 119. The carriage 119 is shifted along guide shafts 121, 122 attached to a chassis 123.

Next, a construction of a drive transmitting mechanism will be explained with reference to FIGS. 14 and 15. In FIG. 14, a first convey roller gear 124 is provided on a roller shaft 111*a* of the first convey roller 111. A first lever 125 is mounted on the roller shaft 111*a* for rotational movement around the roller shaft 111*a*. A planetary gear 126 is held by the first lever 125 for free rotation and is meshed with the first convey roller gear 124 to revolve around this roller gear 124 as a sun gear. A second lever 127 is mounted on the roller shaft 111*a* outside the first lever 125. A torsion coil spring 128 is connected to the first and second levers 125, 127 so that the first lever 125 is biased toward a clockwise direction (FIG. 15) with respect to the second lever 127. By abutting a stopper 125*a* of the first lever 125 against a stopper 127*a* of the second lever 127, a rotational range of the first lever 125 rotated by the torsion coil spring 128 is regulated.

A second convey roller gear 129 is provided on a second convey roller shaft 108*a*. An idler gear 130 is meshed with a sheet supply roller gear 131 provided on a sheet supply roller shaft 105*a*. As the first convey roller gear 124 is rotated, the planetary gear 126 is revolved around the first convey roller gear together with the first lever 125 to be engaged by the second convey roller gear 129 or the idler gear 130. A lever holding member 132 can be shifted in a horizontal direction in FIG. 15, and, when the lever holding member is shifted to the left, the second lever 127 is locked by the lever holding member at a predetermined position (FIG. 17).

Next, a sheet supplying operation will be fully explained on the basis of a sheet supplying flow chart shown in FIG. 19 with reference to FIGS. 20 to 24. When a sheet supplying operation is started, the second lever 127 is released from the lever holding member 132 (step S1). Then, a drive motor (not shown) is rotated reversely with respect to the sheet conveying direction by a predetermined number pulses. As a result, the planetary gear 126 meshed with the first convey roller gear 124 is engaged by the idler gear 130, thereby rotating the sheet supply roller 105 via the sheet supply roller gear 131 to pick up the recording sheet P (step S2; refer to FIG. 20). When the drive motor is rotated reversely by the predetermined number of pulses, a tip end of the recording sheet P is abutted against a nip between the second convey roller 108 and the pressure roller 106 which are now stopped, and a trailing end of the recording sheet is held by the sheet supply roller 105, with the result that the recording sheet P is flexed between the nip and the sheet supply roller (refer to FIG. 21).

Then, the drive motor is rotated normally in the sheet conveying direction by a predetermined amount. As a result, the planetary gear 126 meshed with the first convey roller gear 124 is engaged by the second convey roller gear 129, thereby rotating the second convey roller 108 so that the tip end of the recording sheet P is pinched between the second convey roller 108 and the pressure roller 106 to be conveyed. In this case, since the recording sheet P is pinched between the second convey roller 108 and the pressure roller 106 after the tip end of the recording sheet was abutted against the nip between the second convey roller 108 and the pressure roller 106 and the recording sheet was flexed (i.e., after the tip end of the recording sheet P was aligned with the nip), the skew-feed of the recording sheet is corrected, thereby ensuring the high accurate sheet conveying operation (step S3; refer to FIG. 22). Incidentally, in this case, the number of pulses regarding the normal rotation (forward rotation) of the drive motor is selected so that the second convey roller 108 is not rotated excessively, thereby preventing a tension force from acting on the recording sheet P between the sheet supply roller 105 and the second convey roller 108.

Figure 23:
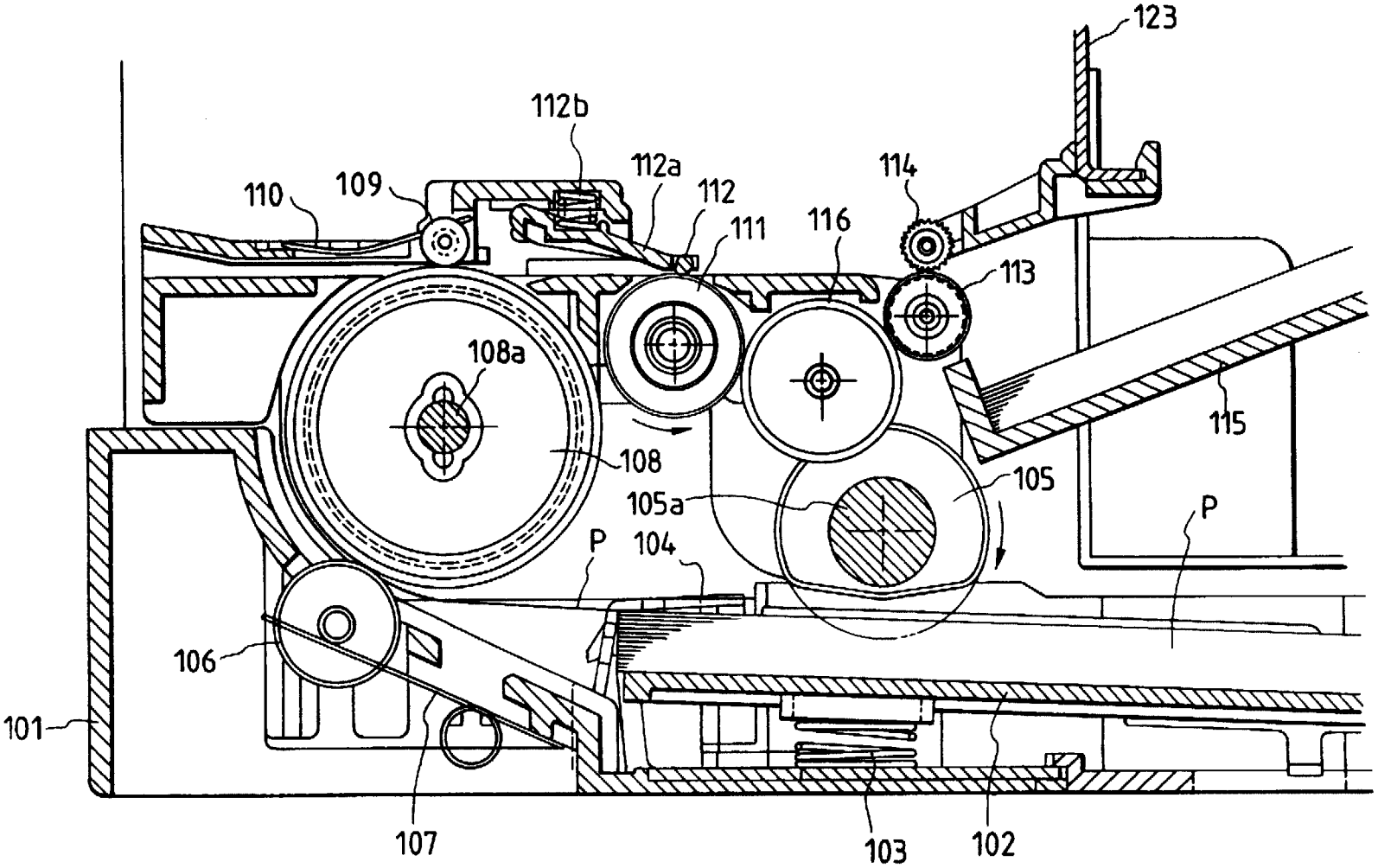
Figure 24:
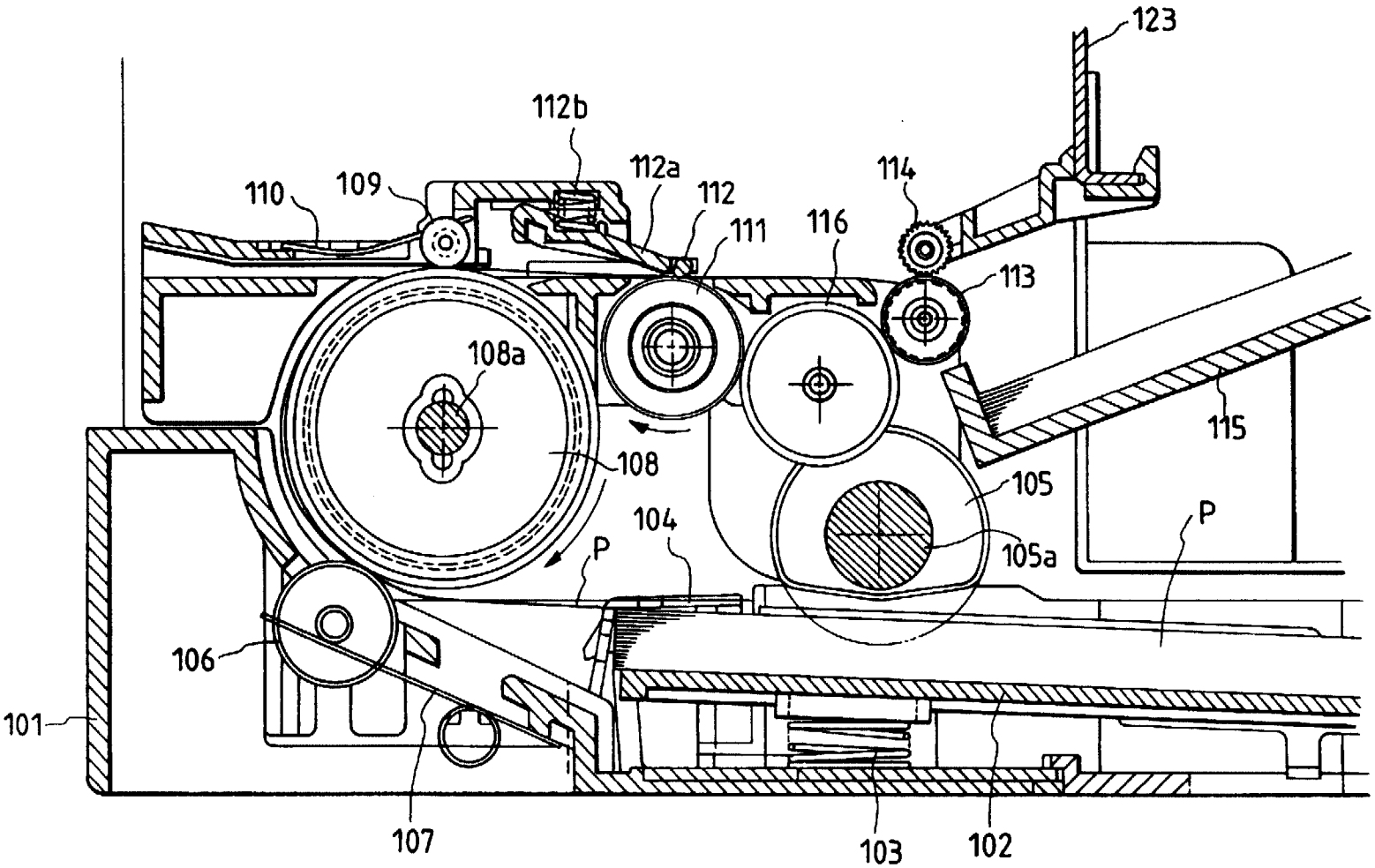
Figure 25:
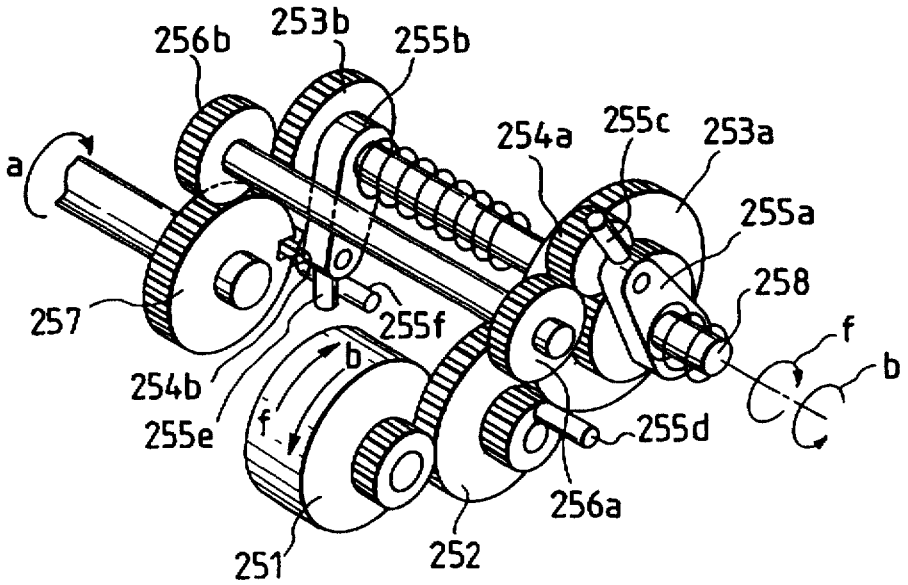
FIG. 25 PRIOR ART
FIGS. 25 to 31 are views showing conventional driving force transmitting mechanisms.
Figure 27:
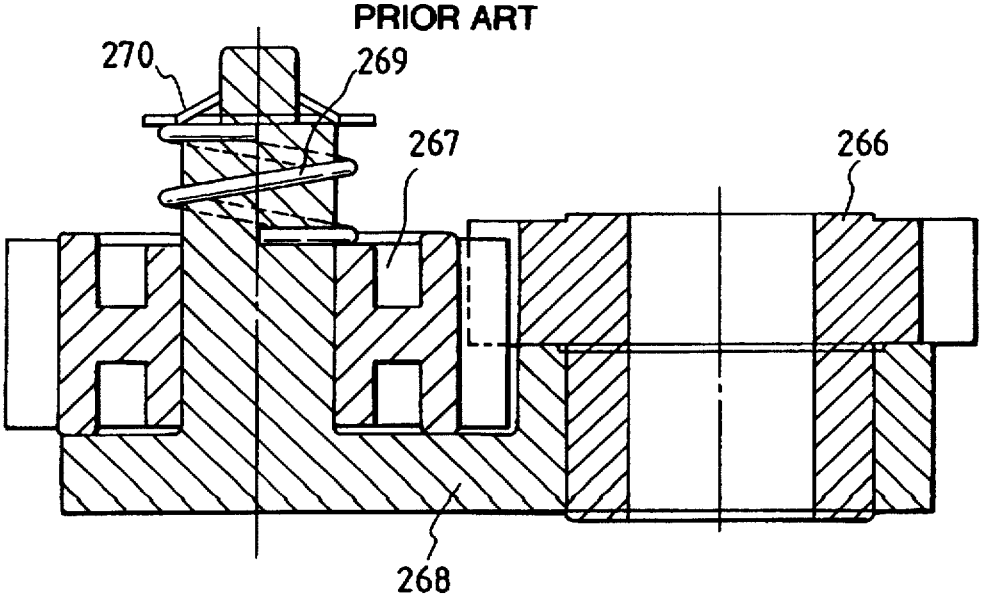
FIG. 27 PRIOR ART
Figure 26:
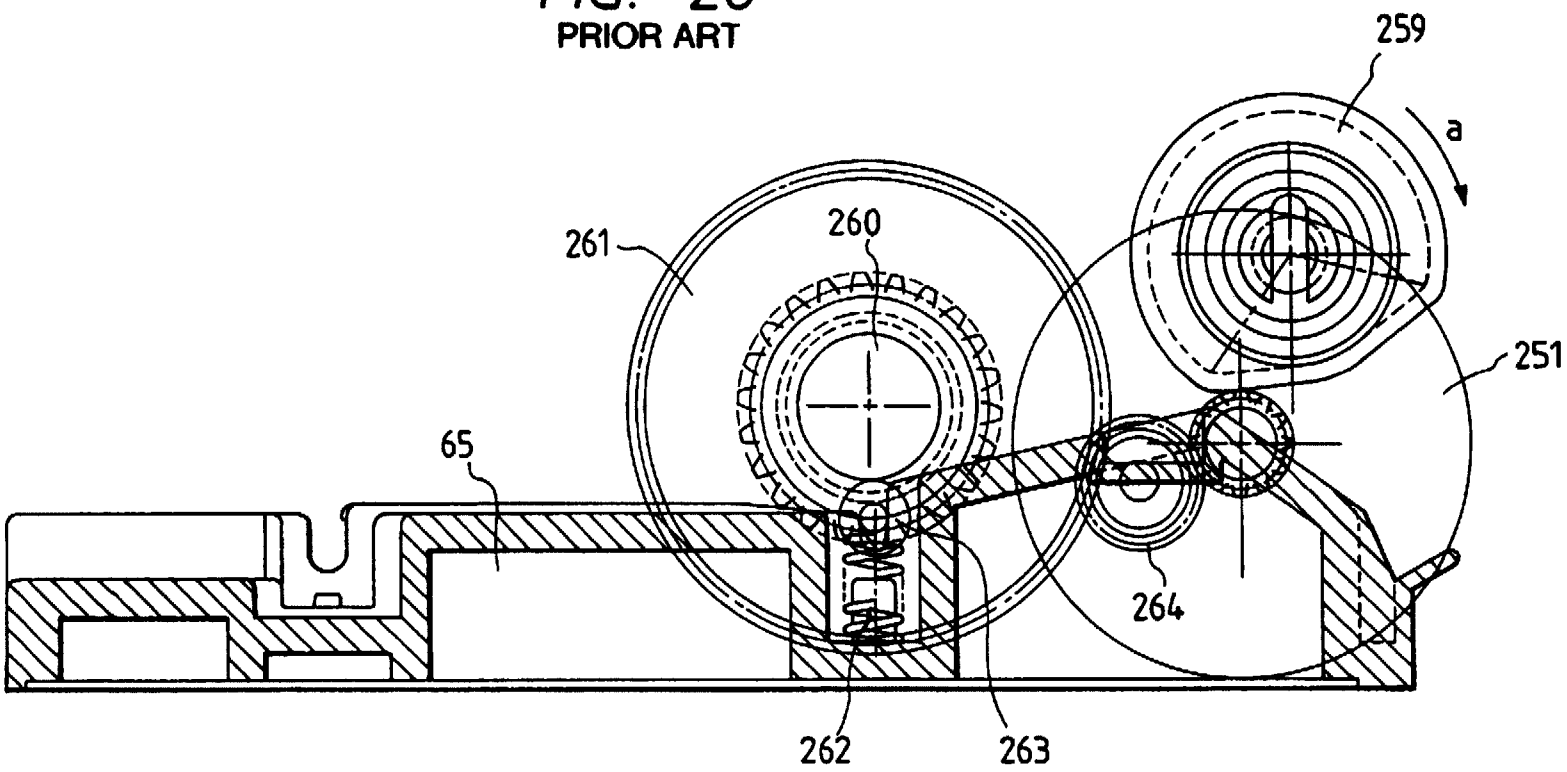
FIG. 26 PRIOR ART
Figure 28:
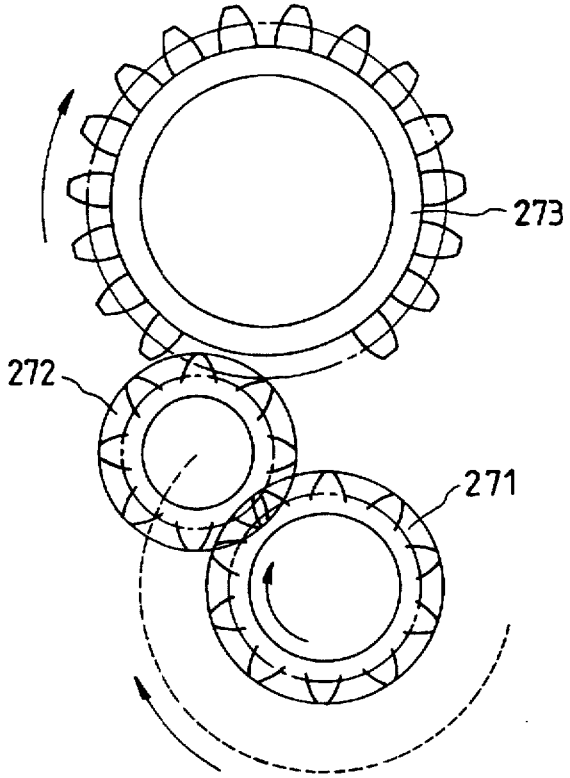
Figure 29:
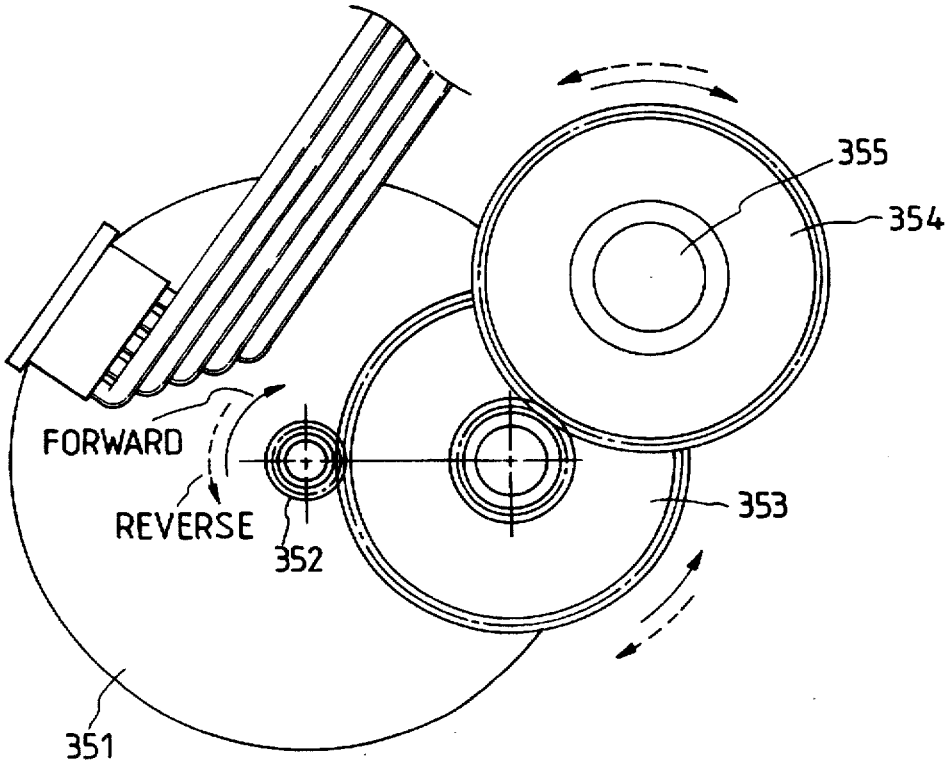
Figure 30:
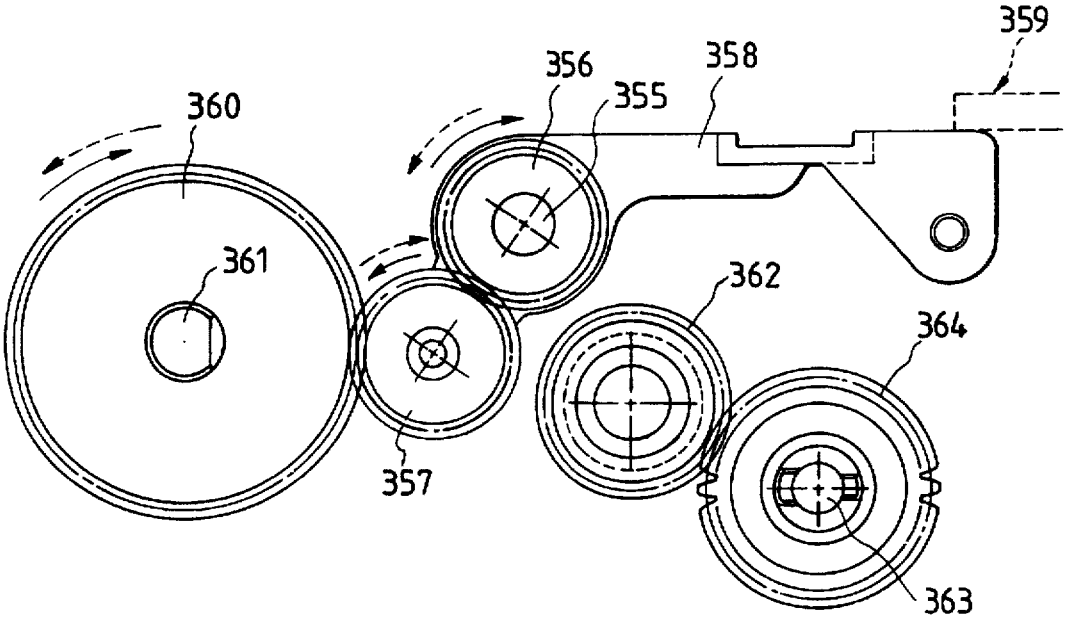
Figure 31:
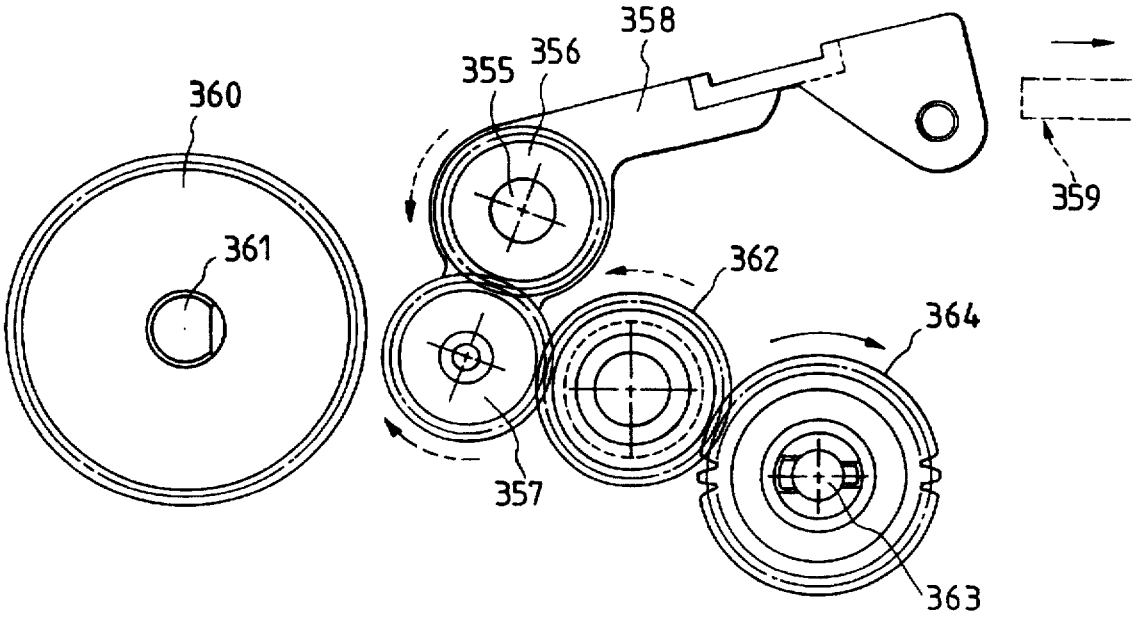

Then, the drive motor is again rotated reversely with respect to the sheet conveying direction by a predetermined amount, thereby rotating the sheet supply roller 105 up to the waiting position where the cut-out of the sheet supply roller is opposed to the recording sheet stack P (step S4; refer to FIG. 23). Then, the drive motor is rotated in the normal direction until the planetary gear 126 is engaged by the second convey roller gear 129. Then, the second lever 127 is locked by the lever holding member 132 (step S5). Thereafter, the drive motor is further rotated in the normal direction by a predetermined amount, with the result that the recording sheet P is firstly pinched between the second convey roller 108 and the pressure roller 106 and then is pinched between the second convey roller 108 and the driven roller 109, thereby conveying the recording sheet forwardly. Then, the recording sheet is pinched between the first convey roller 111 and the pinch roller 112, thereby conveying the recording sheet to the recording start position (step S6; refer to FIG. 24). Then, the image is recorded on the recording sheet by the recording head 117 by shifting the carriage.

Next, the operation of the drive transmitting mechanism during the sheet supplying operation will be explained with reference to FIGS. 15 to 17. Incidentally, in FIGS. 15 to 17, a direction (clockwise direction) shown by the solid line arrow is referred to as "normal rotation (direction)" and a direction (anti-clockwise direction) shown by the broken line arrow is referred to as "reverse rotation (direction)". FIG. 15 shows a condition corresponding to the steps S1 and S2 in the flow chart of FIG. 19. In this condition, the second lever 127 is released from the lever holding member 132, with the result that the first convey roller gear 124 is rotated in the reverse direction. In this case, since the second lever 127 can be freely rotated in the anti-clockwise direction, the first lever 125 can also be rotated freely in the anti-clockwise direction, so that, as the first convey roller gear 124 is rotated, the planetary gear 126 is engaged by the idler gear 130, thereby transmitting the driving force to the sheet supply roller 105 through the idler gear 130.

FIGS. 16 and 17 show conditions corresponding to the steps S5 and S6 in the flow chart of FIG. 19, i.e., conditions when the rotational direction of the first convey roller gear 124 is changed from the reverse direction to the normal direction. In FIG. 16, when the normal rotation of the first convey roller gear 124 is started, the planetary gear 126 is revolved in the clockwise direction as the first convey roller gear 124 is rotated. In this case, the first and second levers 125, 127 are rotated around the first convey roller shaft 111*a* in the clockwise direction. As a result, the planetary gear 126 is engaged by the second convey roller gear 129, thereby transmitting the driving force of the first convey roller gear 124 to the second convey roller gear 129.

Then, as shown in FIG. 17, the lever holding member 132 is shifted to the left (shown by the arrow), thereby locking the second lever 127. A tip end portion 127*a* of the second lever 127 is lowered in the clockwise direction by a tapered portion 132*a* of the lever holding member 132, thereby locking the second lever 127 at the predetermined position. As a result, the first lever 125 is biased in the clockwise direction by the torsion coil spring 128, thereby engaging the planetary gear 126 by the second convey roller gear 129 with a predetermined biasing force. Consequently, the backlash between the planetary gear 126 and the second convey roller gear 129 is eliminated, thereby achieving the good engagement.

Further, in this condition, even when the first convey roller gear 124 is rotated in the reverse direction, since the first lever 125 is biased toward the clockwise direction by a predetermined biasing force, the planetary gear 126 is not rotated in the anti-clockwise direction as the first convey roller gear 124 is rotated reversely, thereby maintaining the good engagement condition between the second convey roller gear 129 and the planetary gear 126.

With the arrangement as mentioned above, since the planetary gear 126 can be engaged by the second convey roller gear 129 with the predetermined biasing force, unlike to the conventional cases, in the back feed operation, the skipping of tooth does not occur, thereby achieving the stable driving force transmission. Accordingly, in the recording apparatus, since the sheet conveying ability can be maintained with high accuracy, high image quality and high reliability can be ensured.

As mentioned above, according to the present invention, since the planetary gear can be engaged by the gear (for example, second convey roller gear) of any one (for example, second convey roller shaft) of the driven shafts with the predetermined biasing force, unlike to the conventional cases, in the back feed operation, the skipping of tooth does not occur, thereby achieving the stable driving force transmission. Accordingly, in the recording apparatus, since the sheet conveying ability can be maintained with high accuracy, high image quality and high reliability can be ensured.

Incidentally, in the illustrated embodiments, while an example that the ink jet recording head is used as the recording means was explained, preferably, the recording means is designed so that the ink is discharged from the discharge opening to effect the recording by growth and contraction of a bubble in the ink formed by the film boiling caused by thermal energy generated from an electrothermal converter energized in response to a record signal.

Preferably, the typical construction and principle of the recording head can be realized by using the fundamental principles, for example, disclosed in U.S. Pat. Nos. 4,723,129 and 5,740,796. Although this system can be applied to both a so-called "on-demand type" and "continuous type", it is more effective when the present invention is particularly applied to the on-demand type, because, by applying at least one drive signal corresponding to the record information and capable of providing the abrupt temperature increase exceeding the nucleate boiling to the electrothermal converters arranged in correspondence to the sheet or liquid passages including the liquid (ink) therein, it is possible to form a bubble in the liquid in correspondence to the drive signal by generating the film boiling on the heat acting surface of the recording head due to the generation of the thermal energy in the electrothermal converters. Due to the growth and contraction of the bubble, the liquid is discharged from the discharge opening to form at least one liquid droplet. When the drive signal has a pulse shape, since the growth and contraction of the bubble can be quickly effected, more excellent liquid charge can be achieved.

Such a pulse-shaped drive signal may be ones disclosed in U.S. Pat. Nos. 4,463,359 and 4,345,262. Incidentally, by adopting the condition disclosed in U.S. Pat. No. 4,313,124 providing the invention regarding the temperature increasing rate on the heat acting surface, a further excellent recording can be performed.

As the construction of the recording head, the present invention includes the construction wherein the heat acting portion is disposed in an arcuate area as disclosed in U.S. Pat. Nos. 4,558,333 and 4,459,600 as well as the constructions wherein the discharge openings, liquid passages and electrothermal converters are combined (straight liquid passages or orthogonal liquid passages).

In addition, the present invention is applicable to the construction wherein each discharge opening is constituted by a slit with which a plurality of electrothermal converters are associated in common as disclosed in Japanese Patent Application Laid-Open No. 59-123670 and the construction wherein openings for absorbing the pressure wave of the thermal energy are arranged in correspondence to the discharge openings as disclosed in Japanese Patent Application Laid-Open No. 59-138461, because the recording can be correctly and efficiently performed regardless of the configuration of the recording head.

Further, the present invention can be applied to a recording head of full-line type having a length corresponding to a maximum width of a recording medium to be recorded. As such a recording head, the construction wherein such a length is attained by combining a plurality of recording heads or a single recording head integrally formed may be adopted.

In addition, among the above-mentioned serial types, the present invention is effectively applicable to a recording head secured to a carriage, or a removable recording head of chip type wherein, when mounted on a carriage, electrical connection between it and the recording system and the supply of ink from the recording system can be permitted, or to a recording head of cartridge type wherein a cartridge is integrally formed with the recording head itself.

Further, it is preferable that a head recovery means and an auxiliary aiding means are added to the recording head according to the present invention, since the effect of the present invention is further improved. More particularly, these means include a capping means for capping the recording head, a cleaning means, a pressurizing or suction means, and an auxiliary heating means comprising electrothermal converters or other heating elements or combination thereof. Further, it is effective for the stable recording to perform an auxiliary discharge mode wherein the ink discharge not relating to the recording ink discharge is effected.

Further, as to the kind and number of the recording heads to be mounted, each recording head may correspond to each different color ink, or a plurality of recording heads can be used for a plurality of inks having different colors and/or different densities. That is to say, for example, the present invention can effectively be applied not only to a recording mode with a single main color such as black, but also to a system providing a plurality of different colors and/or a full-color by mixing colors by using an integrated recording head or combination of plural recording heads.

Furthermore, in the illustrated embodiments, while the ink was liquid, the ink may be solid in a room temperature or less and softened or liquidized at the room temperature. In the ink jet recording systems, since the temperature control is generally effected in a temperature range from 30° C. to 70° C. so that the viscosity of the ink is maintained within a stable discharging range, the ink may be liquidized when the record signal is emitted. In addition, ink having a feature that is firstly liquidized by the thermal energy, such as solid ink which serves to prevent the increase in temperature by absorbing energy in changing the ink from the solid state to the liquid state or which is in the solid state in the reserved condition to prevent the vaporization of the ink and which is liquidized by application of the thermal energy into liquid ink to be discharged in response to the record signal, or ink which has already been solidified upon reaching the recording medium, can also be applied to the present invention.

In such a case, the ink can be held in the liquid state or solid state in recesses or holes in a porous sheet as disclosed in the Japanese Patent Laid-open Nos. 54-56847 and 60-71260, in a confronting relation to the electrothermal converters. Incidentally, in the present invention, the above-mentioned film boiling principle is most effective for each ink.

Further, the aforementioned ink jet recording apparatus may be used as image output terminals of information processing systems such as computers or may be used with a copying machine incorporating a reader therein or a facsimile system having transmission/receiver function.

Incidentally, in the aforementioned embodiments, while an example that the ink jet recording head is used as the recording means was explained, the present invention is not limited to the ink jet recording head, but, a heat-transfer method, a heat-sensitive recording method, or other recording methods other than an impact recording method such as a wire dot recording method can be applied to the present invention. In addition, the present invention is not limited to the serial recording method, but may be applied to a so-called line recording method.

What is claimed is:

1. A recording apparatus comprising:

supply means for supplying a sheet in a predetermined direction;

convey means for conveying the sheet supplied by said supply means in a predetermined direction;

recording means for recording an image on the sheet conveyed by said convey means, in response to image information;

reversible drive means for driving said supply means and said convey means; and drive transmitting means for transmitting a driving force from said drive means to said supply means or said convey means; and wherein said drive transmitting means comprises a plurality of planetary gears as means for rotating said supply means only in a sheet supplying direction regardless of a rotational direction of said convey means, and said planetary gears are revolved around gears having different speed reduction ratios from said drive means as sun gears, respectively.

2. A recording apparatus according to claim 1, further comprising a planetary gear revolved around one of said planetary gears as a sun gear.

3. A recording apparatus according to claim 1, wherein friction force is applied to said planetary gear for restraining a rotation of said planetary gear by utilizing elasticity of a resin member having a holding portion mounted in coaxial with said sun gear and adapted to hold said planetary gear.

4. A recording apparatus according to claim 1, wherein friction force is applied to a holding portion mounted in coaxial with said sun gear and adapted to hold said planetary gear, by utilizing elasticity of a resin member having said holding portion.

5. A recording apparatus according to claim 1, wherein said planetary gear is revolved from engagement position where said planetary gear is engaged by a notched gear to a notched position where said planetary gear is not engaged by said notched gear.

6. A recording apparatus according to claim 1, wherein said recording means is of ink jet recording type in which recording is effected by discharging ink in response to the record signal.

7. A recording apparatus according to claim 6, wherein said recording means includes an electrothermal converter for generating thermal energy used for discharging the ink.

8. A sheet supplying apparatus comprising:

supply means for supplying a sheet in a predetermined direction;

convey means for conveying the sheet supplied by said supply means in a predetermined conveying direction;

reversible drive means for driving said convey means;

supply gear rotated in synchronous with said supply means and adapted to transmit a driving force to said supply means;

first and second sun gears having different speed reduction ratios from said drive means;

first planetary gear meshed with said first sun gear and arranged so that, when said drive means is rotated in a normal direction, said planetary gear is engaged by said supply gear to transmit the driving force for supplying the sheet in the predetermined conveying direction to said supply means and, when said drive means is rotated in a reverse direction, said planetary gear is revolved around said first sun gear away from said supply gear; and second planetary gear meshed with said second sun gear and arranged so that, when said drive means is rotated in the reverse direction, said planetary gear is engaged by said supply gear to transmit the driving force for supplying the sheet in the predetermined conveying direction to said supply means and, when said drive means is rotated in the normal direction, said planetary gear is revolved around said second sun gear away from said supply gear.

9. A sheet supplying apparatus according to claim 8, wherein said first planetary gear also acts as said second sun gear.

10. A sheet supplying apparatus according to claim 8, wherein said supply gear has a non-toothed portion at its periphery.

11. A sheet supplying apparatus according to claim 10, wherein, when said drive means is rotated in the reverse direction and said supply gear is rotated up to a position where said second planetary gear is opposed to said non-toothed portion, a tip end of the sheet supplied by said supply means reaches said convey means, and, thereafter, the sheet is conveyed by a normal rotation of said drive means and said supply means is driven by said first planetary gear until said first planetary gear is opposed to said non-toothed portion.

12. A sheet supplying apparatus according to claim 11, wherein said supply means comprises a supply rotary member provided at its periphery with a sheet supply portion capable of contacting with a sheet stack to convey the sheet and a non-supply portion not contacted with the sheet stack, and wherein, when said non-toothed portion is being opposed to said first planetary gear, said non-supply portion is opposed to the sheet stack.

13. A sheet supplying apparatus according to claim 11, wherein said convey means comprises a pair of convey rotary members for pinching and conveying the sheet, and wherein, when said second planetary gear is being opposed to said non-toothed portion, a tip end of the sheet supplied by said supply means is abutted against a nip between said pair of convey rotary members.

14. A sheet supplying apparatus according to claim 13, wherein, when said drive means is rotated in the normal direction after reverse rotation thereof, said pair of convey rotary members pinch the sheet therebetween and convey the sheet in the predetermined conveying direction, and said supply means pushes the sheet into the nip between said pair of convey rotary members.

15. A sheet supplying apparatus according to claim 8, wherein said second planetary gear has a speed reduction ratio greater than that of said first planetary gear.

16. A sheet supplying apparatus according to claim 15, further comprising treatment means driven by said drive means, and drive transmitting means for selectively transmitting a driving force of said drive means to said treatment means, and wherein, when the driving force is transmitted to said treatment means by said drive transmitting means, said first planetary gear is opposed to said non-toothed portion and said drive means is rotated in the normal direction and the reverse direction alternately within an angular range in which said second planetary gear is not engaged by said supply gear.

17. A sheet supplying apparatus according to claim 16, wherein said treatment means includes a pump.

18. A sheet supplying apparatus according to claim 17, further comprising a nozzle for discharging ink onto the sheet conveyed by said convey means to effect the recording, and wherein said pump sucks the ink from said nozzle.

19. A sheet supplying apparatus according to claim 17, wherein said pump includes a piston reciprocally shifted by the normal and reverse rotations of said drive means.

20. A sheet supplying apparatus according to claim 8, further comprising recording means for effecting the recording with respect to the sheet conveyed by said convey means.

21. A sheet supplying apparatus according to claim 20, wherein said recording means effects the recording by discharging ink.

22. A sheet supplying apparatus according to claim 21, wherein said recording means discharges the ink by utilizing thermal energy.

23. A driving force transmitting mechanism comprising:

a drive shaft having a gear for transmitting a driving force;

a plurality of driven shafts each having a gear to which the driving force is selectively transmitted in accordance with a normal rotation or a reverse rotation of said drive shaft;

a planetary gear meshed with the gear of said drive shaft to selectively transmit the driving force to any one of said driven shafts;

rocking means freely rotatable on said drive shaft and adapted to hold said planetary gear; and rocking means holding means for holding said rocking means at a predetermined position;

said rocking means including a first rocking member having a planetary gear revolving about said drive shaft, and a second rocking member to be held at a predetermined position by said rocking means holding means; and a resilient member engaged with the first rocking member and the second rocking member, wherein the second rocking member is held at the predetermined position by said rocking means holding means, said resilient member deforms to bias the first rocking member so that said planetary gear meshes with the gear on one of said plurality of driven shafts.

24. A recording apparatus comprising:

recording material containing means for containing stacked recording materials;

supply means for feeding out the recording material contained in said recording material containing means;

convey means for conveying the recording material fed out by said supply means to a recording station;

recording means for recording an image on the recording material conveyed by said convey means, in response to image information; and a driving force transmitting mechanism comprising:

a plurality of driven shafts each having a gear to which the driving force is selectively transmitted in accordance with a normal rotation or a reverse rotation of said drive shaft;

planetary gear meshed with the gear of said drive shaft to selectively transmit the driving force to any one of said driven shafts;

rocking means freely rotatable on said drive shaft and adapted to hold said planetary gear; and rocking means holding means for holding said rocking means at a predetermined position;

said rocking means including a first rocking member having a planetary gear revolving about said drive shaft, and a second rocking member to be held at a predetermined position by said rocking means holding means; and a resilient member engaged with the first rocking member and the second rocking member, wherein, when the second rocking member is held at the predetermined position by said rocking means holding means, said resilient member deforms to bias the first rocking member so that said planetary gear meshes with the gear on one of said plurality of driven shafts.

25. A recording apparatus according to claim 24, wherein said driving force transmitting mechanism causes said planetary gear to be engaged by the gear of the driven shaft of said convey means in a condition that said rotary member is held by said rotary member holding means, thereby transmitting the driving force to said convey means regardless of the normal and reverse rotations of said drive shaft, and, in a condition that said rotary member is released from said rotary member holding means, a driving force of said drive shaft in a direction opposite to a recording material conveying direction is transmitted to said supply means.

26. A recording apparatus according to claim 25, wherein said convey means has first and second convey rollers, and said drive shaft acts as a rotary shaft of said first convey roller.

27. A recording apparatus according to claim 24, wherein said recording means is of ink jet recording type in which recording is effected by discharging ink in response to the record signal.

28. A recording apparatus according to claim 27, wherein said recording means includes an electrothermal converter for generating thermal energy used for discharging the ink.

29. A recording apparatus according to claim 28, wherein said recording means discharges the ink from a discharge opening by utilizing film boiling of the ink caused by thermal energy applied from said electrothermal converter.

* * * * *

UNITED STATES PATENT AND TRADEMARK OFFICE

CERTIFICATE OF CORRECTION

PATENT NO. : 5,793,399

DATED : August 11, 1998

INVENTOR(S) : HIDEAKI KAWAKAMI, ET AL.

It is certified that error appears in the above-identified patent and that said Letters Patent is hereby corrected as shown below:

COVER PAGE[56] REFERENCES CITED,
Foreign Patent Documents, insert --0 495 109 07/1992 European Patent Office--, and --0 505 969 09/1992 European Patent Office--.

COLUMN 6,
Line 65, "an" should read --a--.

COLUMN 12,
Line 35, "synchronous" should read --synchronism--.

COLUMN 16,
Line 20, "to" should read --in--.

COLUMN 18,
Line 9, "been" should be deleted.

COLUMN 20,
Line 34, "to" should read --in--.

COLUMN 23,
Line 34, "synchronous" should read --synchronism--.

Signed and Sealed this

Eleventh Day of April, 2000

*Attest:*

*Attesting Officer*

Q. TODD DICKINSON

*Director of Patents and Trademarks*